US005234353A

United States Patent [19]

Scholz et al.

[11] Patent Number: 5,234,353

[45] Date of Patent: Aug. 10, 1993

[54] HYBRID INPUT/OUTPUT CONNECTOR HAVING LOW MATING FORCE AND HIGH CYCLE LIFE AND CONTACTS THEREFOR

[75] Inventors: James P. Scholz; David T. Shaffer, both of Mechanicsburg; Brent D. Yohn, Newport, all of Pa.

[73] Assignee: AMP Incorporated, Harrisburg, Pa.

[21] Appl. No.: 855,364

[22] Filed: Mar. 20, 1992

Related U.S. Application Data

[63] Continuation-in-part of Ser. No. 841,665, Mar. 3, 1992, abandoned.

[51] Int. Cl.[5] ..... H01R 13/28

[52] U.S. Cl. ..... 439/289; 439/291; 439/293

[58] Field of Search ..... 439/79, 287, 289-293, 439/824, 834

[56] References Cited

U.S. PATENT DOCUMENTS

| | | | |
|---|---|---|---|
| 3,960,424 | 6/1976 | Weisenburger | 339/17 M |
| 4,330,164 | 5/1982 | Pittman et al. | 439/293 |
| 4,439,000 | 3/1984 | Kaufman et al. | 339/176 MP |
| 4,655,515 | 4/1987 | Hamsher, Jr. et al. | 339/14 R |
| 4,737,118 | 4/1988 | Lockard | 439/293 |
| 4,780,095 | 10/1988 | Classon et al. | 439/637 |
| 4,789,351 | 12/1988 | Fisher, Jr. et al. | 439/248 |
| 4,963,102 | 10/1990 | Gettig et al. | 439/291 |
| 4,984,383 | 1/1991 | Mummey et al. | 439/259 |
| 5,080,604 | 1/1992 | Rider et al. | 439/357 |

FOREIGN PATENT DOCUMENTS

| | | | |
|---|---|---|---|
| 1455081 | 11/1976 | United Kingdom | 439/289 |

OTHER PUBLICATIONS

U.S. patent application Ser. N. 07/966,476 filed Sep. 30, 1991 Scholz, et al. (Abstract & Drawings).

*AMP Catalog* 80-570, "Guide to RF Connectors," pp. 172-173, May 1990; AMP Inc., Harrisburg, Pa.

*Primary Examiner*—Paula A. Bradley

*Attorney, Agent, or Firm*—Anton P. Ness

[57] ABSTRACT

An assembly of matable connectors includes first and second connectors (10,100) each including housings (16,116) having a respective plurality of signal contacts (24,124) each having a front contact section (46,146) extending transversely of the connector's mating face (12,112) to a free end (52,152) from a bend section (44,144) adjoining the contact's body section (40,140). The front contact sections (46,146) of each associated pair extend forwardly of the respective mating faces to engage each other proximate their free ends and deflect each other rearwardly about bend sections (44,144), which results in low mating force and high cycle life. The connector housings (16,116) can include a durable latching system comprising a latch arm (18) of one connector (10) having a spaced apart pair of beams (208) having pairs of latches (210) and each being received into latching slots (252) of the other connector (100) near both lateral ends of the connectors, latching proximate both lateral ends.

25 Claims, 18 Drawing Sheets

FIG. 10
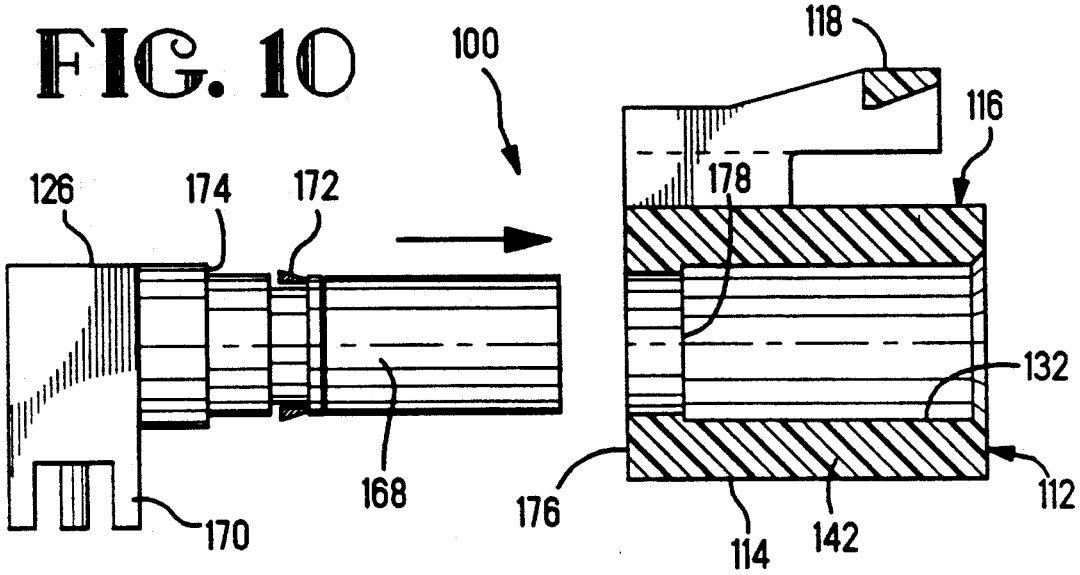
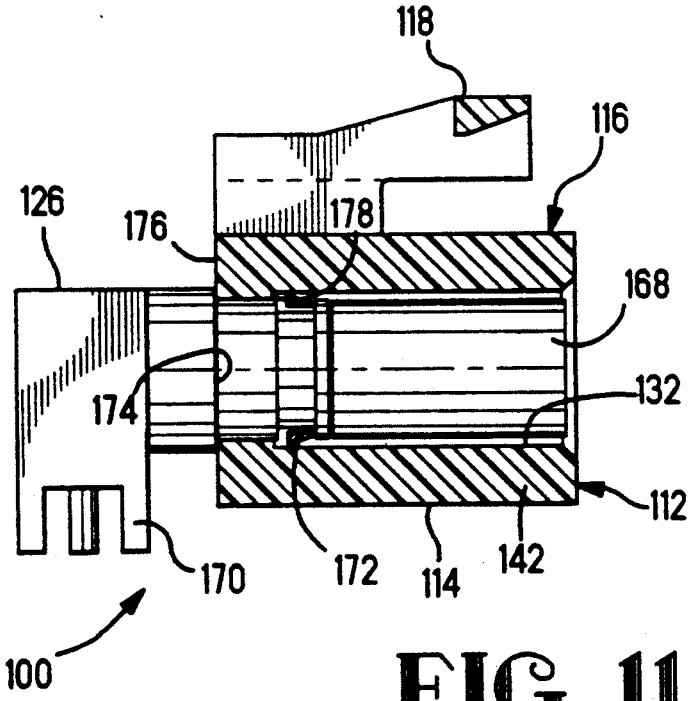
FIG. 11

HYBRID INPUT/OUTPUT CONNECTOR HAVING LOW MATING FORCE AND HIGH CYCLE LIFE AND CONTACTS THEREFOR

RELATED APPLICATION DATA

This is Continuation-in-Part of U.S. Pat. application Ser. No. 07/841,665 filed Mar. 3, 1992 now abandoned.

FIELD OF THE INVENTION

This relates to the field of electrical connectors and more particularly to matable and unmatable electrical connectors having signal contacts.

BACKGROUND OF THE INVENTION

Where electrical connectors include a plurality of electrical contacts to be mated, it is generally desired to provide contacts which are matable without substantial force required and yet establish an assured electrical connection therebetween. Certain connectors provide an array of signal contacts as well as coaxial connectors within common housings which are adapted to be mated together and latched or otherwise held in mated relationship, which are generally referred to as hybrid connectors; there are known coaxial connectors contained in such housings which provide an inner or signal center conductor and an outer or ground conductor concentrically around the inner conductor's insulative shell, all as a subassembly insertable into a large cavity of the housing and retained therein. One such matable coaxial connector assembly is sold by AMP Incorporated under Part Nos. 221162-1 and 228618-5 Size 8 Contacts for cable termination and printed circuit board mounting respectively.

It is desired to provide a hybrid connector assembly which is matable under low force and is adapted to provide a long in-service life involving many cycles of mating and unmating.

SUMMARY OF THE INVENTION

The present invention provides a plug connector and a receptacle connector matable therewith, having an elongate array of signal contacts in at least one row across a center portion of the mating interface, and coaxial connectors at each end of the connector's mating interface.

The signal contacts comprise mating pairs of like resilient cantilever beam contact arms which are disposed transverse of the mating interface and extend slightly forwardly of the front face of the housing to engage each other and deflect free ends of each other slightly rearwardly and mostly into the respective protective cavities. Body sections of the contacts extend axially rearwardly along respective passageways along which they are retained by interference fit by retention flanges or serrations, extending to a rearward contact section disposed in a rear portion of the housing. The rearward contact section may be of the insulation displacement type wherein an end of an insulated conductor wire is pushed into a slot between spring beams which penetrate the insulative jacket and electrically engage the conductor wire therein, enabling such connector to be terminated to a cable; another type of contact section could be a post adapted to be disposed in a plated through-hole of a circuit board and soldered, for mounting of such connector on a printed circuit board. Preferably the spring beam contact arms are preloaded with free ends disposed behind a retention surface along a side wall of the cavity along the mating interface, thus providing an assured axial location of the frontmost contact surface. The frontmost contact surface may be defined on a convex arcuate embossment on both contact arms near their free ends spaced from the fulcrum, or on one thereof engageable with a flat surface of the other, or in a third embodiment may comprise ends of forwardly angled elongate contact beams.

In a fourth embodiment of the present invention, alternating ones of the array of front contact sections extend transversely in opposing directions to contact surfaces in staggered rows, matable with contact sections of a complementary connector having similarly alternating ones of front contact sections. The front contact sections may comprise ends of forwardly angled elongate contact beams. Such an arrangement permits closer spacing of contact members from each other for a higher density connector and balancing of mating forces across two spaced rows. The rear contact sections of one of the connectors may also comprise tails adapted to be surface mounted to a printed circuit board, being spring arms held under spring bias against respective traces of the board when the connector is fastened to the board, and thereafter preferably soldered.

In one embodiment and as another aspect of the present invention, a novel durable latch system is provided having a pair of latch arms extending forwardly from a common large manually engageable bar joined to a top surface of a receptacle-type housing and easily accessible, which is adapted to be manually deflected inwardly towards the top surface of the housing to delatch the connectors for unmating. The pair of spaced latch arms latch with corresponding latch projections of the plug-type housing after passing under latching sections thereof which deflects the latch arms toward the housing until latched therebehind. Latching at spaced apart locations across the top of the housing provides balanced forces holding the mated contacts in assured mated condition.

It is an objective of the present invention to provide a hybrid connector assembly matable under low mating forces and having long-term durability over at least 5000 mating cycles.

It is also an objective for the contacts of such connector assembly be adapted for resistance to wear by mating with low friction, while attaining wipe to remove oxides from the engaging contact surfaces.

Additionally it is an objective for one of the connectors to be terminatable to a cable end while the other is mountable to a printed circuit board, thus defining an input/output connector for an electronic apparatus such as a portable cellular phone.

It is a further objective for a connector to have a single enlarged top surface accessible manual engagement latch arm, facilitating delatching by the thumb of a gloved hand.

Embodiments of the present invention will now be described by way of example with reference to the accompanying drawings.

BRIEF DESCRIPTION OF THE DRAWINGS

FIGS. 2 and 3 are representative of the mating signal contacts of the present invention, in which FIG. 2 illustrates the contacts of a first embodiment about to engage, and FIG. 3 showing the contacts upon mating;

FIGS. 10 and 11 are longitudinal section views of the connector of FIGS. 7 to 9 showing the circuit board mountable coaxial connector being inserted into a respective housing cavity;

DETAILED DESCRIPTION OF THE PREFERRED EMBODIMENTS

Figure 1:
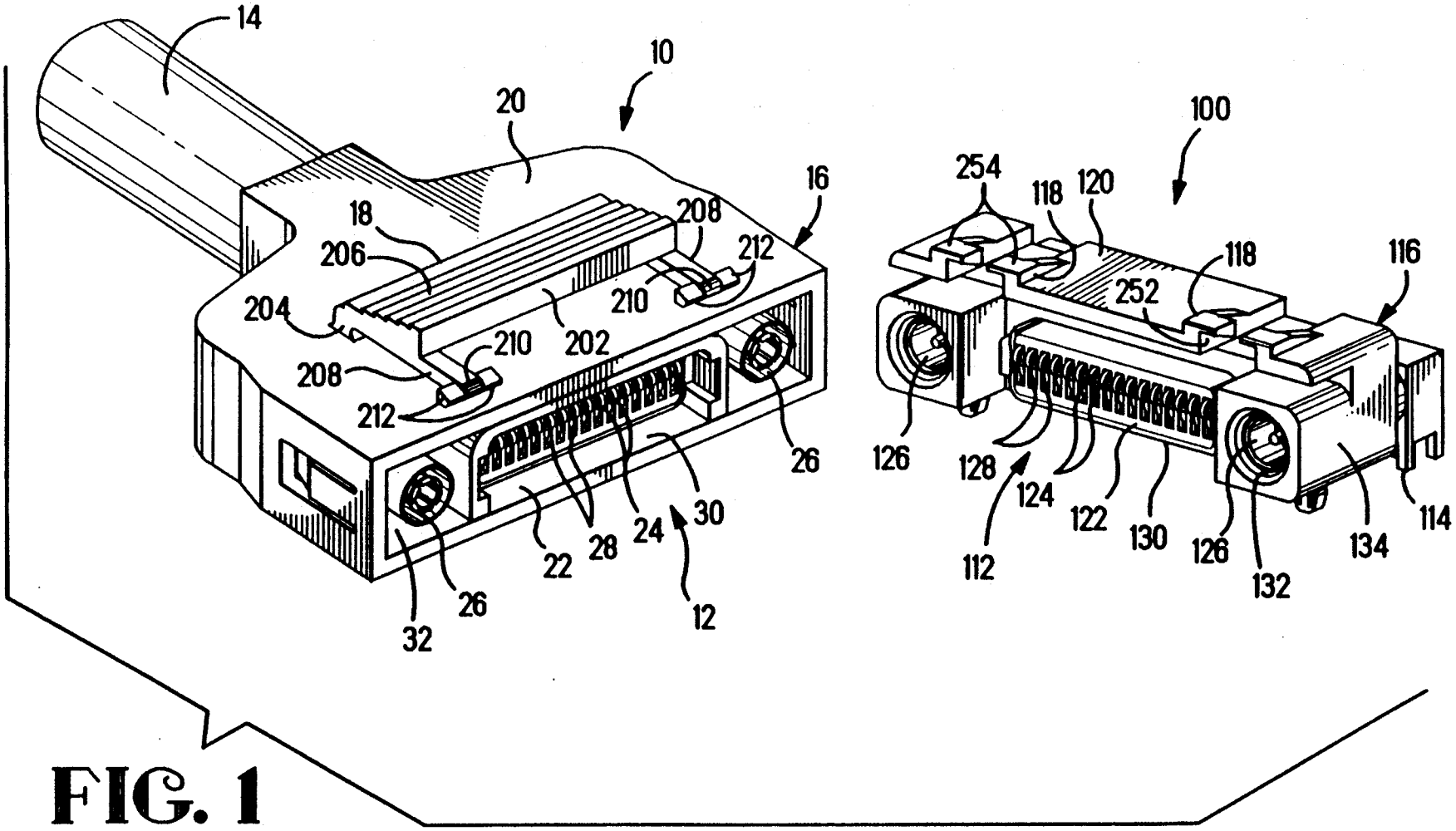
FIG. 1 is an isometric view of the matable connectors along their respective mating interfaces, illustrating the contact array and the latching system.

The connector of the present invention includes a receptacle connector 10 and a plug connector 100, shown in FIG. 1 opposing each other and matable at respective mating faces 12,112, with receptacle connector 10 shown terminated to a multiconductor cable 14 and plug connector 100 shown having a mounting face 114 adapted for mounting to a circuit board (not shown) such as within an electronic apparatus such as a cellular phone (not shown). Cable 14 may extend to a base unit (not shown) for such a cellular phone, such as in a vehicle. Housing 16 of connector 10 includes a latching structure 18 along a major side surface such as top surface 20, while housing 116 of connector 100 includes a complementary latching structure 118 along its top surface 120 enabling the connectors to be latched together upon being mated. The latching system of the present invention is shown and described in greater particularity with respect to FIGS. 14 to 17.

Each mating face includes an elongate array 22,122 of signal contacts 24,124 disposed between two coaxial connectors 26,126. Contacts 124 are disposed in respective cavities 128 across the front of a plug section 130 in a manner exposed for electrical engagement with corresponding contacts 24; contacts 24 are similarly disposed in respective cavities 28 of housing 16 and are surrounded by a common shroud section 30 adapted to receive plug section 130 thereinto. Each coaxial connector 126 of connector 100 is secured within a cavity 132 of an associated plug portion 134 which is adapted to be received into a plug-receiving cavity 32 of connector 10 surrounding a respective coaxial connector 26 thereof, all shown and described in greater particularity with respect to FIGS. 10 to 13.

To facilitate the description of the present inventions, the remaining FIGS. 2 to 9 and 14 to 17 depict the connectors or portions thereof inverted as compared to FIG. 1.

Figure 2:
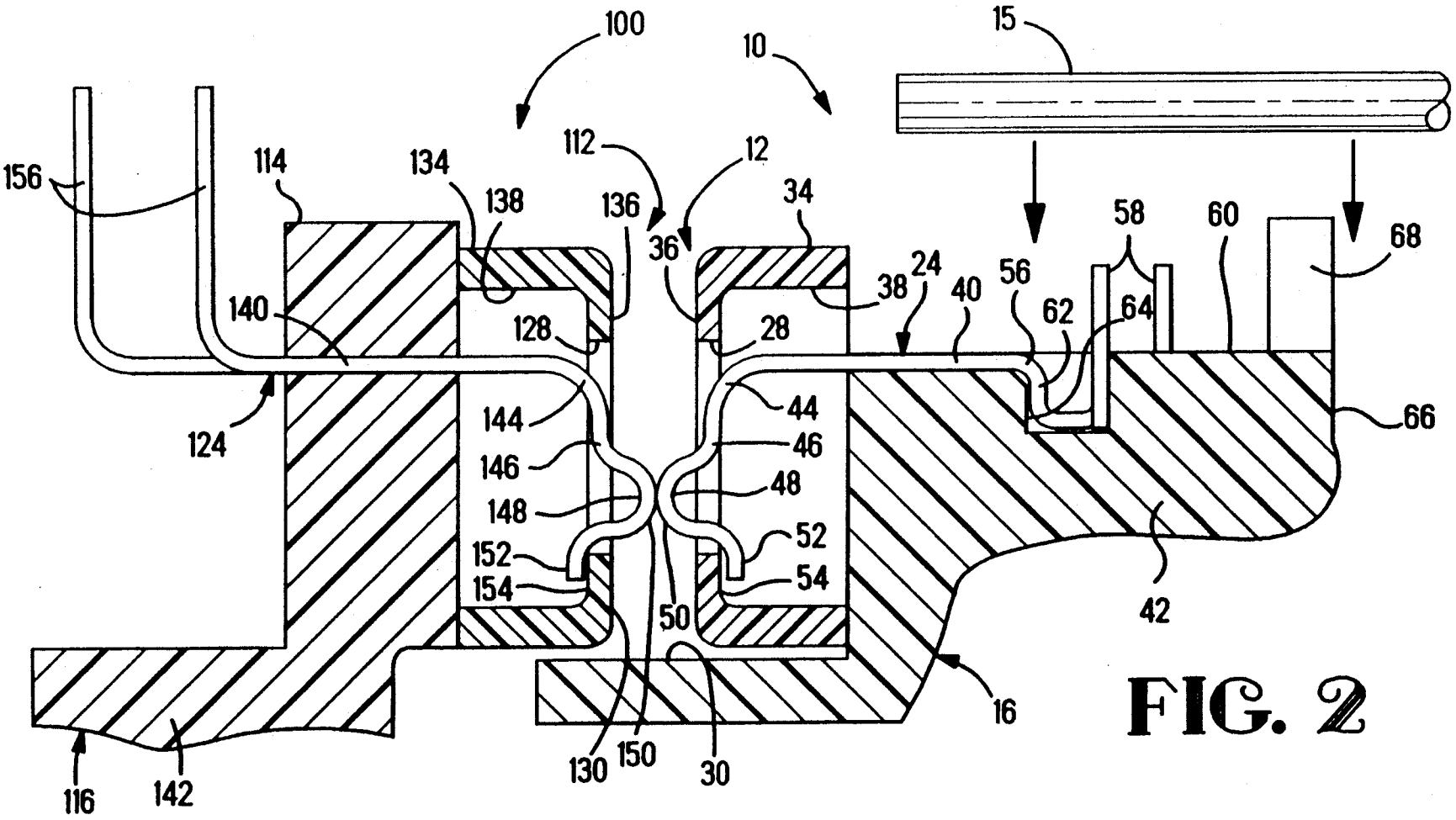
Figure 3:
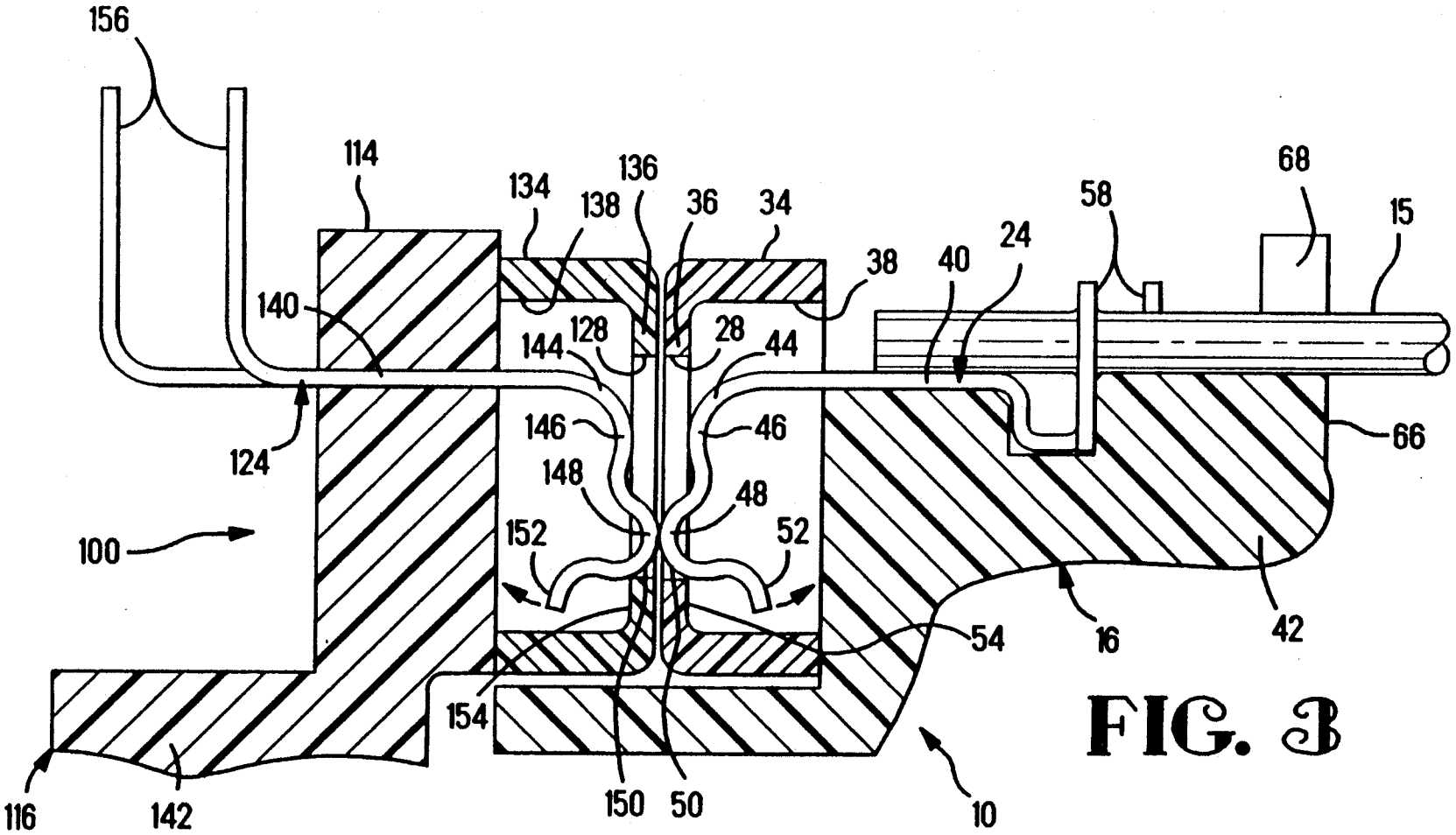

Referring to FIGS. 2 and 3, connectors 10,100 are shown being mated at mating faces 12,112; more particularly, a pair of associated contacts 24,124 are shown being mated, plug section 130 being received into shroud 30. The forward ends of contacts 24,124 are protected by like front housing members 34,134 respectively which include cavities 28,128 across a transverse housing section 36,136 in communication with a common cavity 38,138 therebehind. Each contact 24,124 includes an axially disposed body section 40,140 extending forwardly from body sections 42,142 of housings 16,116 respectively to bend sections 44,144 which define fulcra for transversely extending front sections 46,146 which define spring beams. Convex embossments 48,148 are formed on front sections 46,146 which extend forwardly beyond transverse housing sections 36,136 to forwardly facing contact surfaces 50,150 and then extend rearwardly to free ends 52,152 which are spring loaded against and behind ledges 54,154 of transverse housing sections 36,136 thus assuring that contact surfaces 50 are coplanar and contact surfaces 150 are coplanar. In FIG. 3 convex embossments 48,148 of contacts 24,124 have engaged and contact surfaces 50,150 bear against each other, thereby deflecting front contact sections 46,146 rearwardly about fulcra 44,144, rotating free ends 52,152 rearwardly from ledges 54,154. The moderate amount of force used to bring contact surfaces 50,150 against each other to establish sufficient contact normal force for an assured electrical connection, also causes the wiping action necessary to eliminate incremental corrosion on contact surfaces 50,150 as with matable electrical contacts in general. Contacts 24,124 may be made of beryllium copper, for example.

Also seen in FIGS. 2 and 3 are rear contact sections of the contacts, with contacts 124 having right angled posts 156 (shown arrayed in two rows) extending first axially rearwardly from housing body section 142 and then "downwardly" to extend from mounting face 114 to eventually be received into plated through holes of a printed circuit board. Alternatively, contacts 124 may have rear contact sections adapted for conventional surface mounting Housing body 142 could preferably be made of liquid crystal polymer, thus having high temperature resistance suitable for reflow soldering operations to electrically convert rear contact sections of contacts 124 to plated through holes (or trace pads) of a printed circuit board. With cable terminatable connector 10, the rear contact sections of contacts 24 may be of the insulation displacement type greatly facilitating termination to insulated conductor wires. Rear sections 56 include insulation displacement (or IDC) sections 58 extending transversely (shown arrayed in two rows) and outwardly from surface 60 of housing body 42 and are slotted to permit an end of an insulated wire 15 to be urged thereinto from laterally thereof with edges of the opposed beams of IDC section 58 penetrating the insulation and engaging the conductor therewithin, as is conventional. Retention sections 62 are formed to be force fit into recesses 64 into surface 60 of housing body 42 and body section 40 includes widened retention flanges 41 dimensioned to generate an interference fit with side walls of channels 43 along which body sections 40 extend. Insulated wires 15 of cable 14 extend rearwardly of cable face 66 of housing 16 through respective slots 68.

Figure 4:
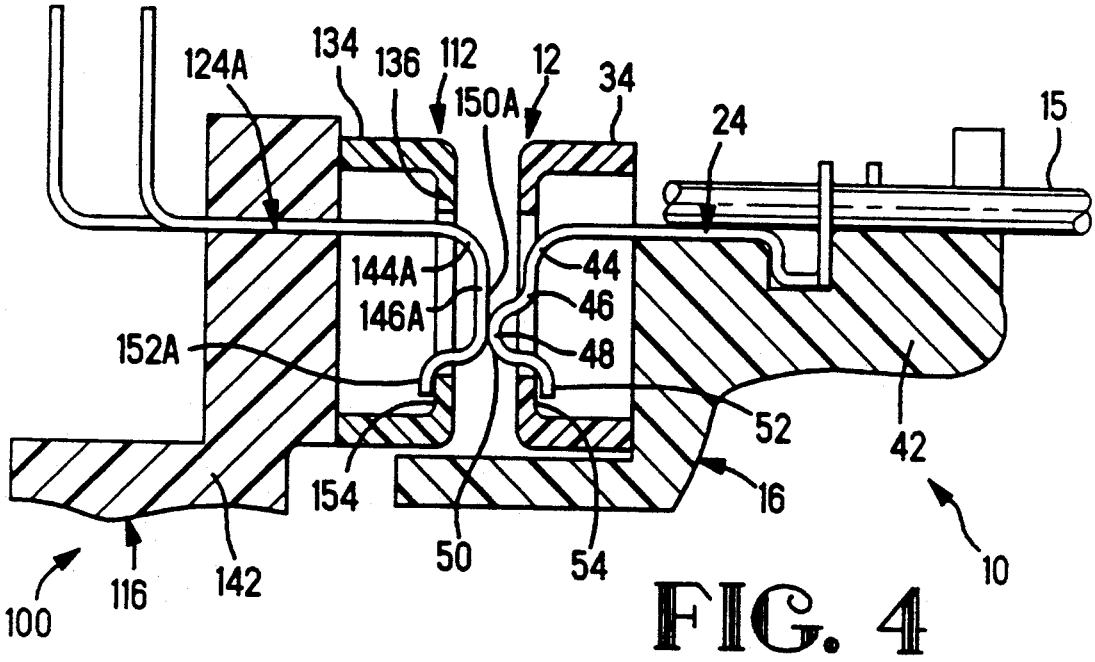
FIGS. 4 and 5 are elevation views of a second embodiment of mating signal contacts before and upon mating respectively, usable in the same housing design.
Figure 5:
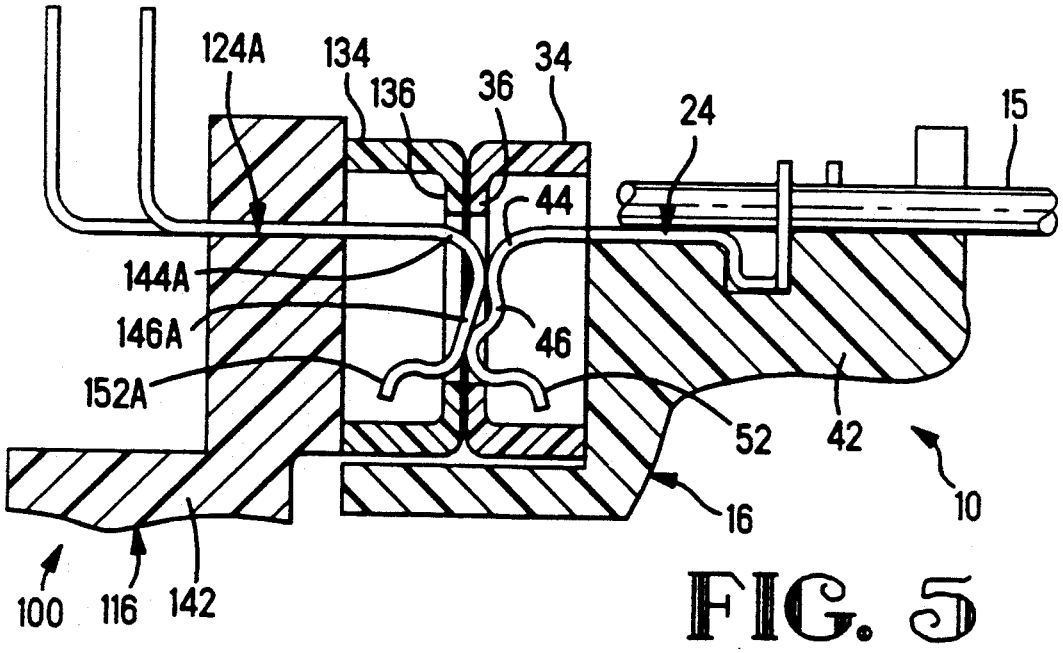

Referring to FIGS. 4 and 5, an alternate style of contact 124A is shown in which front section 146A extends transversely from fulcrum 144A as with contact 124 of FIGS. 2 and 3, with fulcrum 144A located forwardly of transverse housing section 136. Front section 146A comprises a flat embossment extending forwardly to engage a mating contact 24, essentially defining a simple elongate beam extending to free end 152A preloaded behind ledge 154 as with contact 124. Upon mating, front sections 46,146A deflect and rotate each other about the respective fulcra 44,144A to generate a spring loading of engaged contact surfaces 50,150A. An advantage of this contact design is that it provides greater contact target area which is more forgiving of overall tolerance variations of the assembly; the design would provide stability of contact surfaces remaining engaged after abutment under load since only one of the contact (50) surfaces is disposed on a radiused formation (embossment 48).

Figure 6:
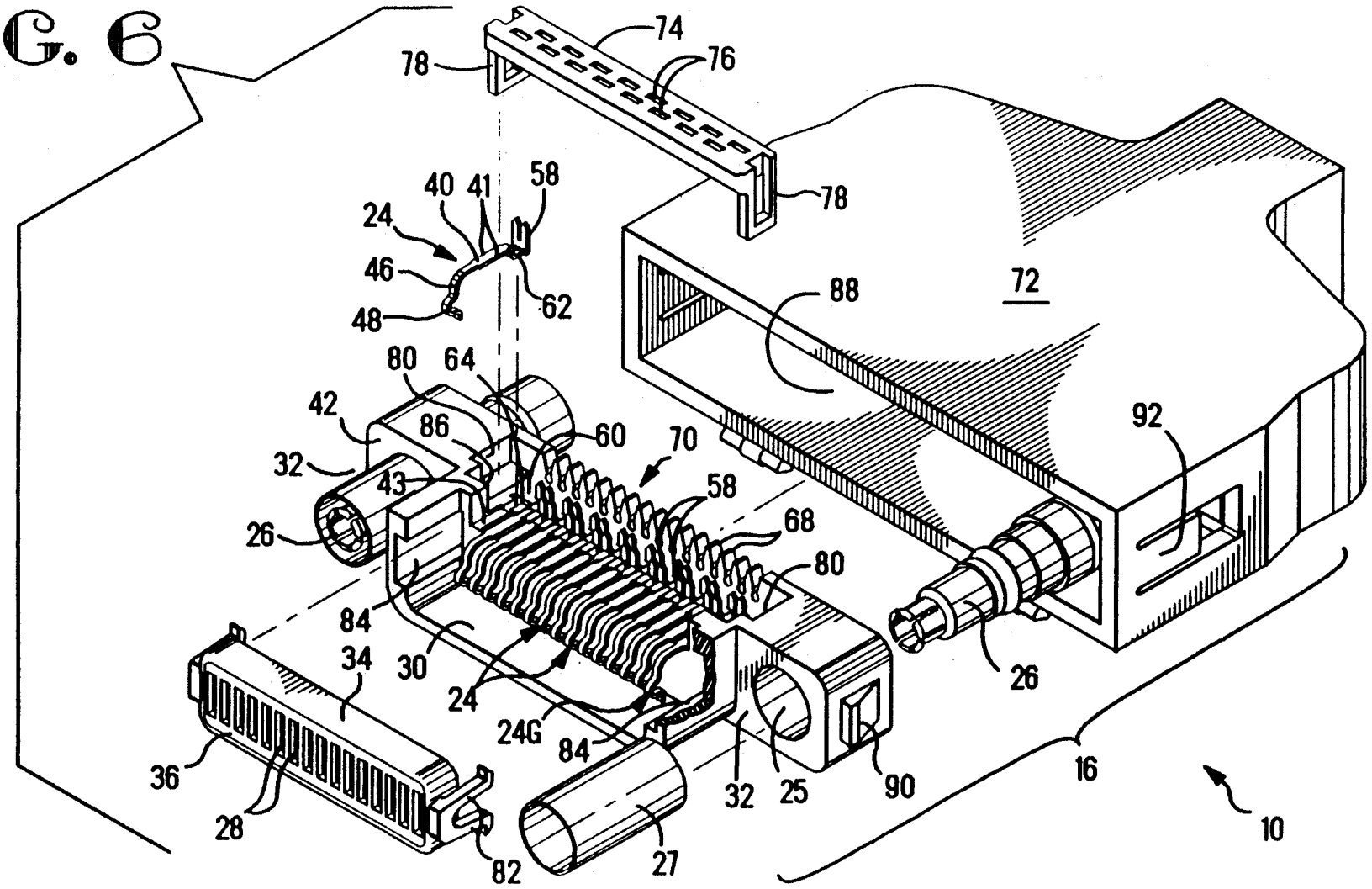
FIG. 6 is an exploded isometric view of the cable connector from the lower surface thereof, illustrative of the assembly procedure and also showing the manner of termination of the signal contacts to respective conductors.

The various parts of connector 10 are shown in FIG. 6 positioned to be assembled to housing body 42. Contacts 24 are inserted from relatively above housing body 42, pushed into respective channels across surface 60. Retention sections 62 are force fit into respective recesses 64, with slightly wider flanges of side edges of IDC sections 58 pressing tightly against the side walls thereof. IDC sections 58 protrude upwardly from surface 60 with slots thereof aligned with respective wire clamping slots 68 and defining a wire receiving face 70 for the plurality of wires (not shown) extending from the outer jacket of cable 14 inserted through a cable exit of outer cover 72. After the wires are clamped in respective slots 68, termination cover 74 would then be pushed onto the wire array to urge the wires into respective IDC slots of sections 58 thus terminating the wires. Upper ends of IDC sections 58 are received into respective slits 76 formed in termination cover 74 which serve to reinforce the pairs of beams to penetrate the wire insulation, all as is conventional. Latch arms 78 depend from each end of termination cover 74 to be received into recesses 80 to each side of surface 60 and latch with corresponding latching projections therealong (not shown).

Front cover 34 is placed over the front sections 46 of contacts 24 so that the front sections 46 are received into respective cavities 28 in transverse housing section 36; pairs of latch arms 82 at each end of front cover 34 are received into corresponding channels 84 along side walls of shroud 30, the arms of each pair deflected toward each other until fully inserted, which then latch behind rearwardly facing ledges 86. Coaxial connectors 26 already terminated on coaxial cables (not shown) are inserted into large cavities 25 in housing body 42 and latch therewithin (see FIGS. 12 and 13) along with cylindrical forward outer conductor member 27 thereof, extending forwardly into recesses 32 (FIG. 1). The assembly thus defined is then inserted into housing receiving cavity 88 of outer cover 72, with latching projections 90 along each side of housing body 42 deflecting and then latching behind corresponding latch arms 92 along side walls of outer cover 72, securing the assembly in place and defining connector 10.

Figure 7:
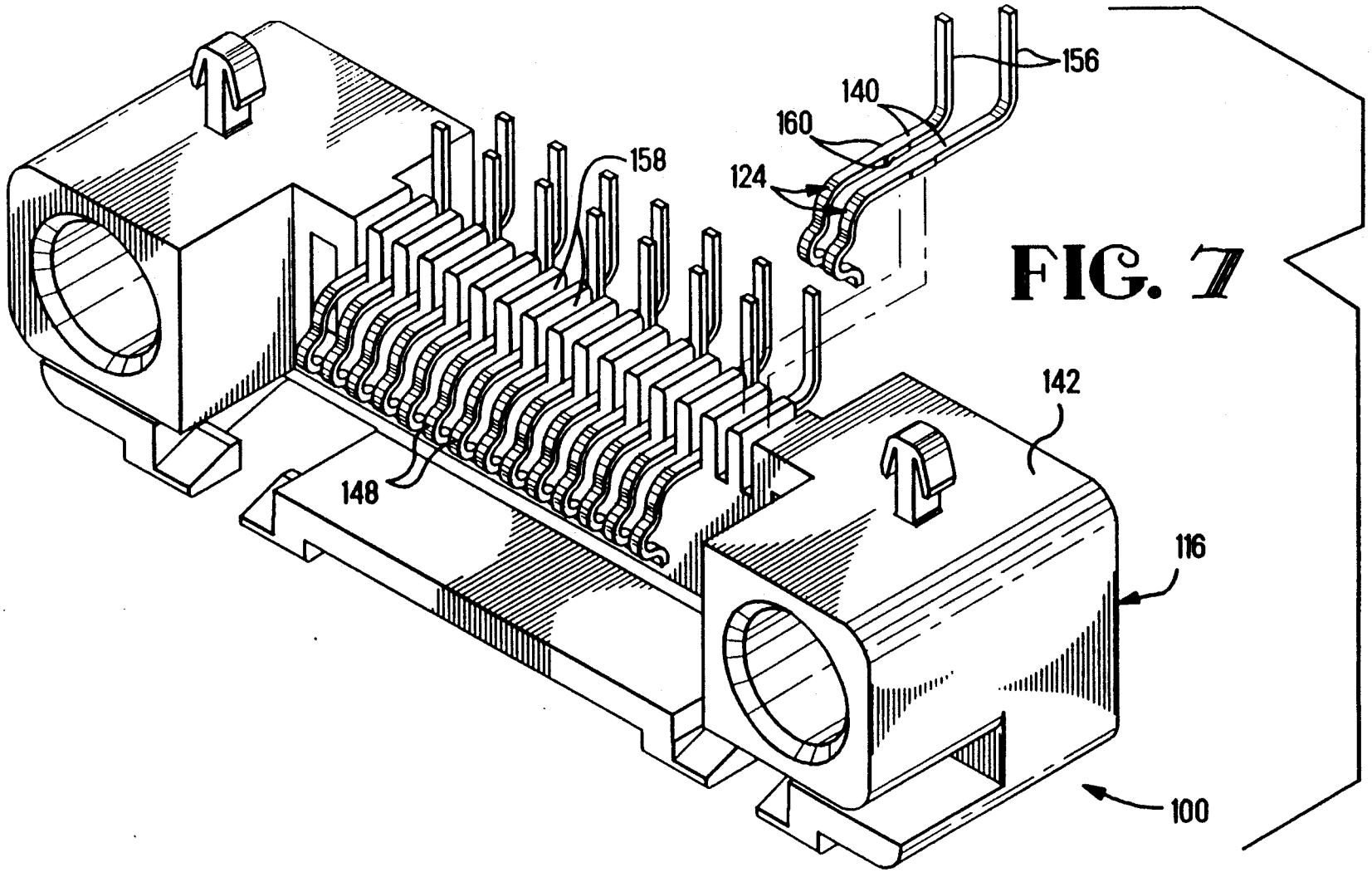
FIGS. 7 and 8 are exploded isometric views of two embodiments of the main housing body of the circuit board connector from the lower surfaces thereof, illustrative of two alternative manners of assembly of signal contacts into the housing.

The contacts of connector 100 may be assembled as shown in FIG. 7, wherein contacts 124 are inserted into slots 158 and include slightly wider retention flanges 160 along body sections 140 to establish an interference fit with side walls of slots 158; thereafter, potting material or a separate cover member (not shown) or heat or ultrasonic staking may be used to close the slots and establish insulative material to surround the contact body sections 140.

Figure 8:
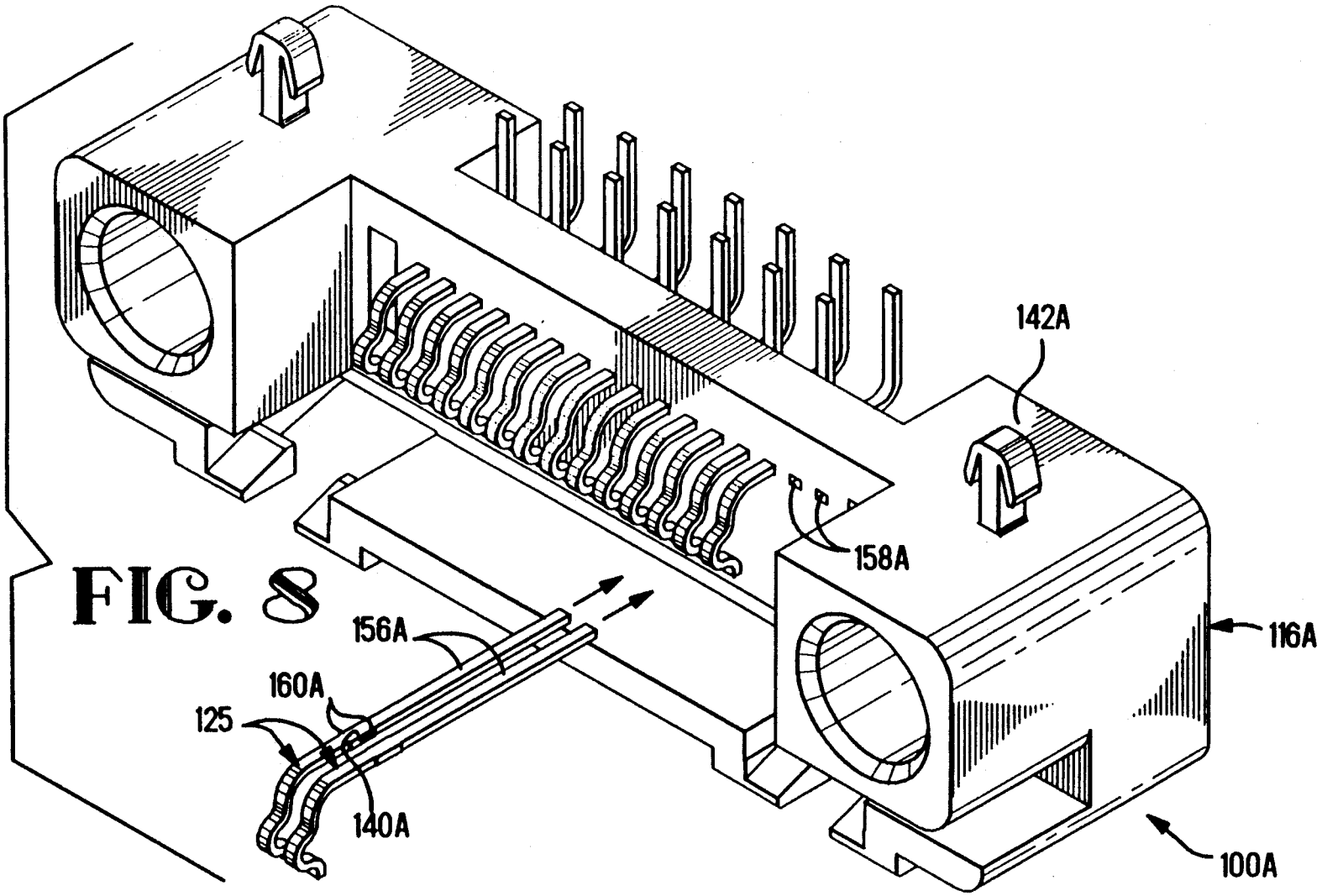

The contacts of the circuit board mountable connector may also be assembled as shown in FIG. 8 with respect to connector 100A, wherein contacts 125 initially having straight rear contact sections 156A are stitched into respective passageways 158A of housing body 142A and include slightly wider retention flanges 160A along body sections 140A to establish an interference fit in passageways 158A, after which rear contact sections 156A are bent around right angles.

Figure 9:
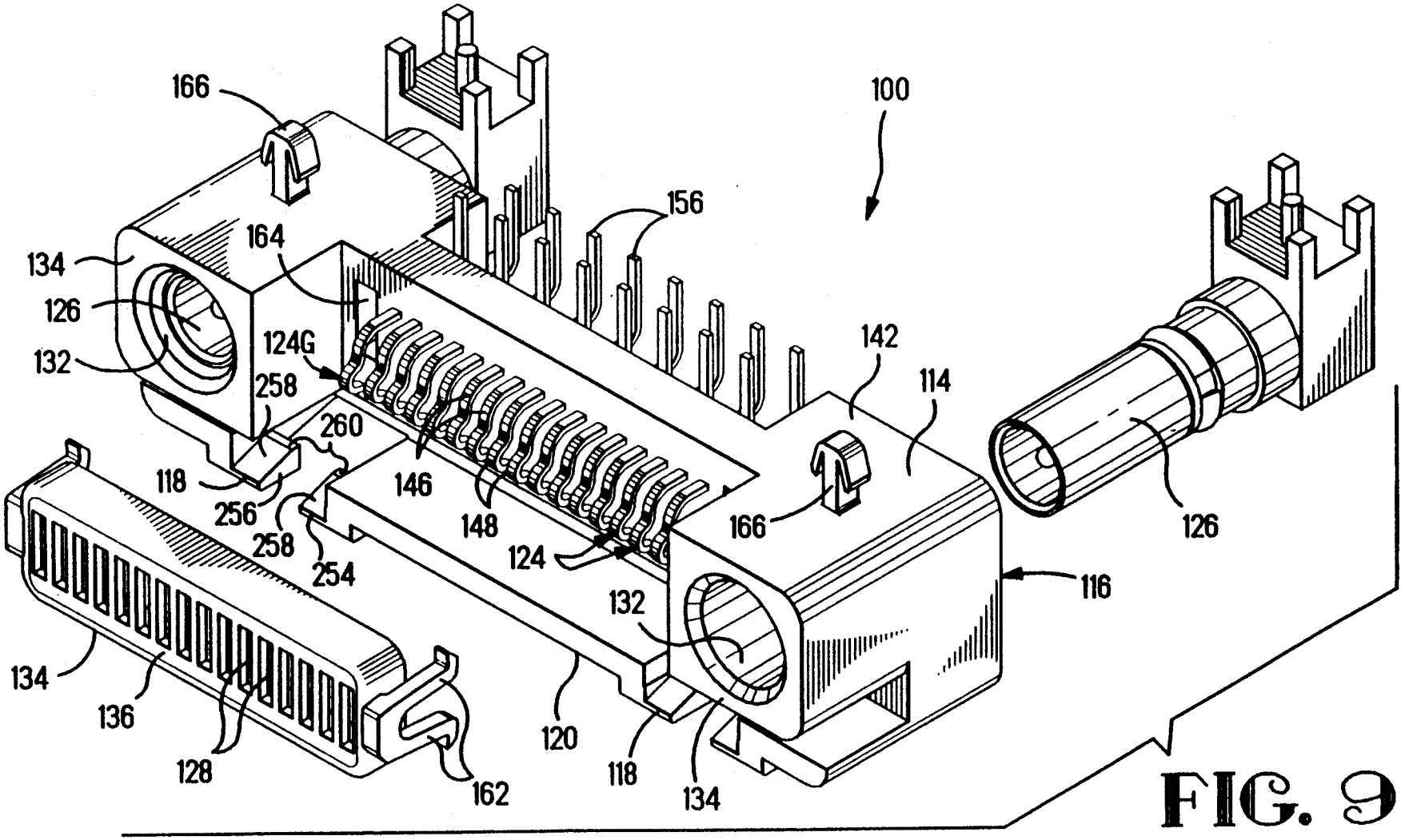
FIG. 9 is an isometric view of the forward housing member and the coaxial connector poised to be assembled to the main housing body of the connector of FIGS. 7 and 8.

Full assembly of connector 100 is shown in FIG. 9, with front cover 134 being inserted from the front over front contact sections 146, with cavities 128 received therearound. Latch arms pairs 162 received into slots 164 and latching behind ledges (not shown) similarly to front cover 34 of connector 10 in FIG. 6. Coaxial connectors 126 are inserted into large cavities 132 from rearwardly, described in more detail with respect to FIGS. 10 and 11. Board locks 166 are seen extending from mounting face 114, which will be received into corresponding mounting holes in a printed circuit board (not shown), as is conventional. Also seen in FIG. 9 is latching mechanism 118 of connector 100 which will be described in detail with respect to FIGS. 14 to 17. One 124G of the contacts of connector 100 extends farther forwardly than the others 124: in cooperation with contact 24G of connector 10 (see FIG. 6) contacts 24G,124G will engage each other first to perform a task preliminary to mating such as activating a switch on the circuit board to which connector 100 is mounted; the contacts may also be connected to a ground wire of cable 14, serving to dissipate electrostatic potential which commonly exists between electronic apparatus, thus protecting the connector and its electronic components from electrostatic discharge.

Figure 12:
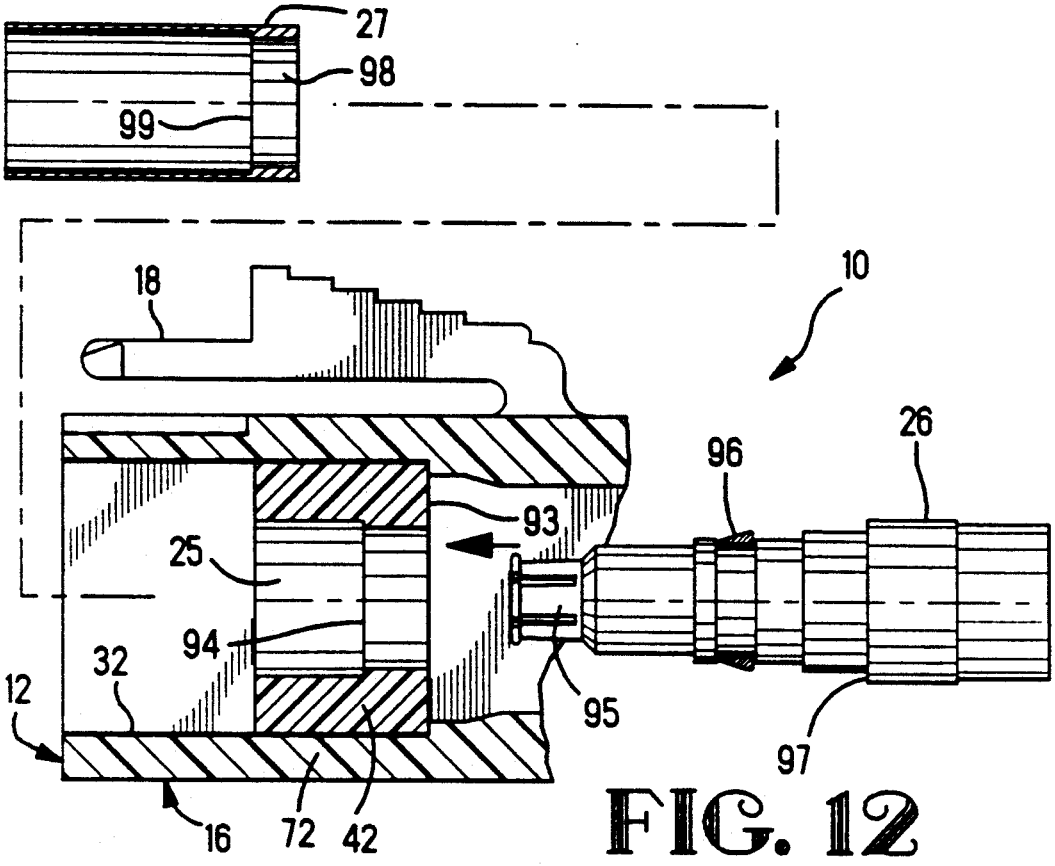
FIGS. 12 and 13 are longitudinal section views of the cable connector of FIG. 6 showing the cable-terminatable coaxial connector being assembled into the housing.
Figure 13:
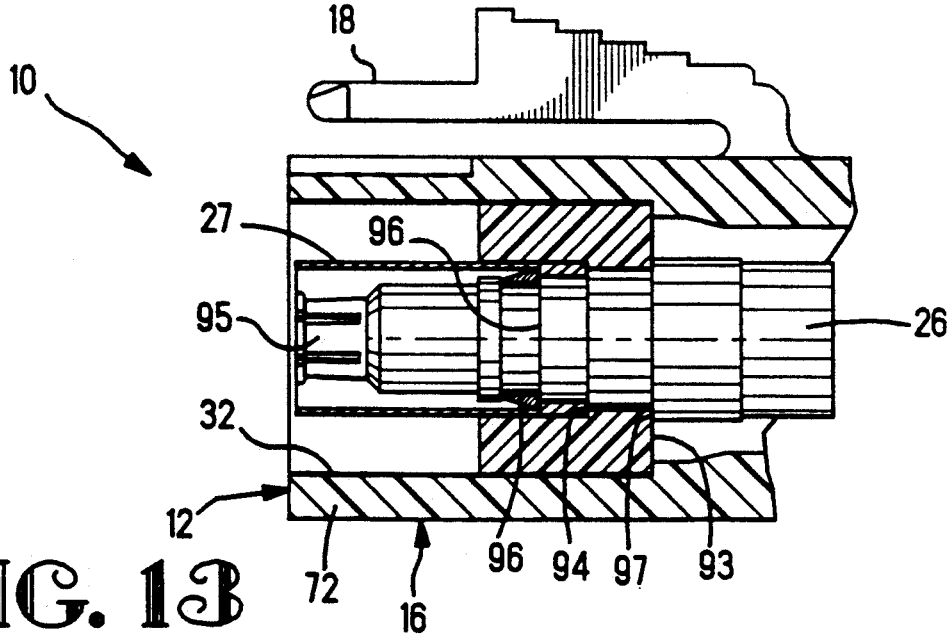
Figure 14:
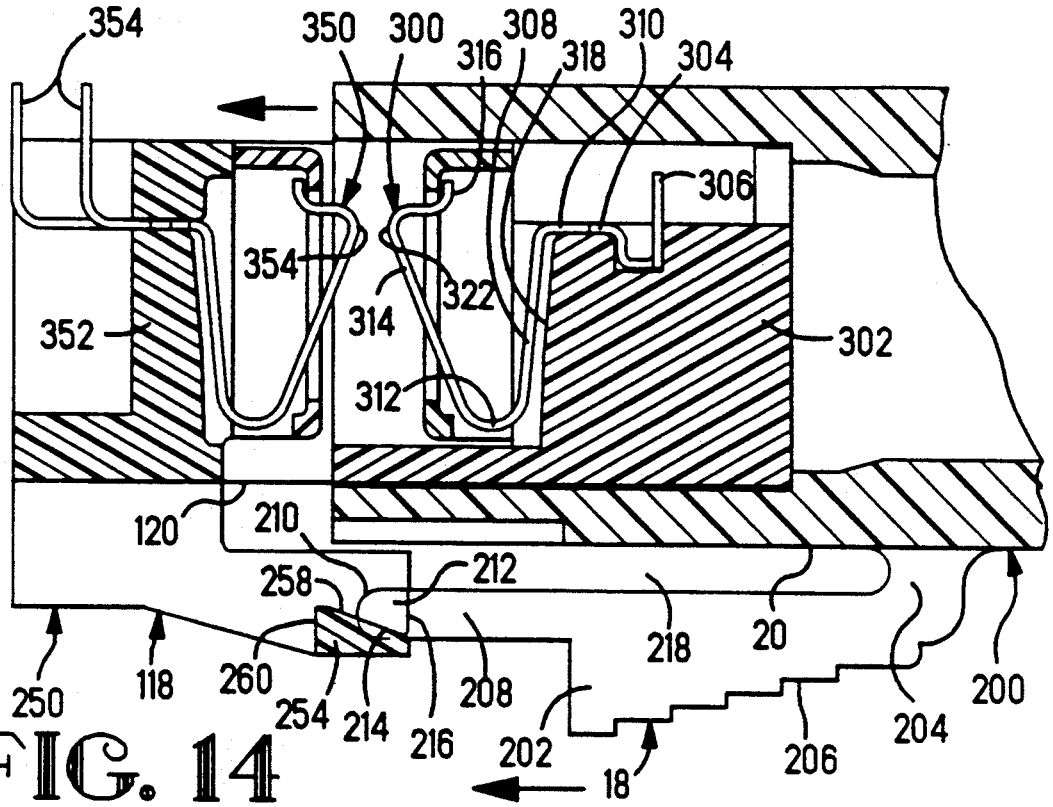
FIGS. 14 to 17 are longitudinal section views of the connectors and the latching system of the present invention in various stages of mating and latching, and showing a third embodiment of mating signal contacts in housings adapted therefor.

Coaxial connectors 126 are assembled into connector 100 as shown in FIGS. 10 and 11, while coaxial connectors 26 are assembled into connector 10 in FIGS. 12 and 13, all as is disclosed in U.S. Pat. No. 4,789,351. Connector 126 includes an outer contact 168 extending forwardly from a board mountable conductive shell 170 of the type sold by AMP Incorporated, Harrisburg, Pa. as Part No. 228618-5. Disposed rearwardly of an annular collar near the center is a retention clip 172; just forwardly of shell 170 is a large diameter section defining a forwardly facing shoulder 174. Coaxial connector 126 is inserted from a rear face 176 of housing body 142 into a smaller diameter portion of cavity 132, which defines a forwardly facing ledge or stop surface 178 part way therealong. Upon full insertion, shoulder 174 abuts rear face 176 around cavity 132 stopping forward movement; retention clip 172 is initially compressed during passing through the smaller diameter cavity portion and expands after passing ledge 178, thus locking coaxial connector 126 in position in cavity 132 of connector 100.

Coaxial connector 26 of connector 10 in FIGS. 12 and 13 includes an outer contact 95 having an annular collar midway therealong behind which is secured a retention clip 96; a forwardly facing ledge or stop surface 97 is defined near the rearward end. Outer contact member 27 includes a smaller diameter rearward section 98 defining a forwardly facing ledge or stop surface 99, and is insertable from the mating face of connector housing 16 into cavity 25 of housing body 42 until its rearward end abuts a forwardly facing ledge 94 of cavity 25. Coaxial connector 26 is inserted into cavity 25 from rear face 93 of housing body 42 and into outer contact member 27 until stop surface 97 abuts rear face 93. Retention clip 96 is radially compressed until passing through smaller diameter rearward section 98 and passes by ledge 99 whereafter it reexpands, locking coaxial connector 26 in position in connector 10 and simultaneously locking outer contact member 27 in position. Such a coaxial connector is sold by AMP Incorporated under Part No. 221162-1. Similar coaxial connectors are disclosed in U.S. Pat. No. 4,789,351 one of which includes a coil spring to provide for good impedance performance of the coaxial connector while the coil springs for both coaxial connectors used in the hybrid connector of the present invention would contribute a modest increase in overall requisite connector mating forces.

FIGS. 14 to 17 disclose the progression of connector latching of the system 18,118 of the present invention, and simultaneously show a third contact design alternative to those of FIGS. 2 to 5. Referring also to FIGS. 1 and 9, latch arm 18 includes a transverse body section 202 joined at its rearward end to housing surface 20 at joint 204 and includes a profiled surface 206 adapted for manual engagement during deflection for connector unmating. Latch arm 18 includes a pair of forwardly extending beams 208 joined to latch arm body section 202 at laterally spaced apart locations and extending to rounded free ends 210. To each side of each free end 210 is a laterally extending embossment 212 having a tapered bearing surface 214. Each embossment 212 forms a rearwardly facing latching surface 216 along the sides of forwardly extending beams 208. A relief recess 218 is defined between beams 208 and surface 20 for deflection of latch arm 18 there towards during mating and unmating.

Latching mechanism 118 is complementary to latch arm 18 and includes correspondingly spaced apart slots 252 wide enough to receive thereinto beam free ends 210 and their pair of laterally extending embossments 212, with outer slot wall sections 254 being split by narrow central channels 256 to receive rounded free ends 210 thereinto. To each side of narrow central channel 256 is a pair of camming surfaces 258 defined on outer slot wall sections 254 and facing housing surface 120 and angled slightly forwardly, engageable with tapered bearing surfaces 214 of embossments 212 during connector mating. Outer slot wall sections 254 include rearwardly facing latching surfaces 260 behind which latching surfaces 216 of embossments 212 of latch arm 18 latch upon full mating of the connectors. Latch arm 18 is easily deflected inwardly to delatch the latching system of the present invention to unmate the connectors.

Figure 15:
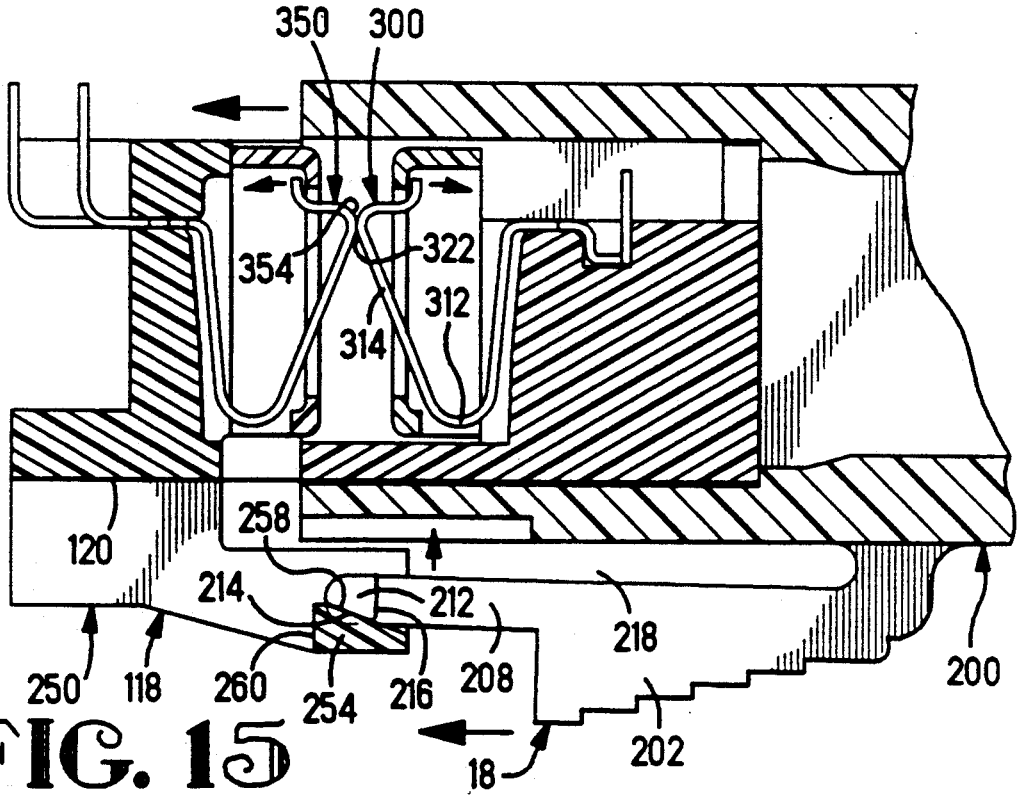
Figure 16:
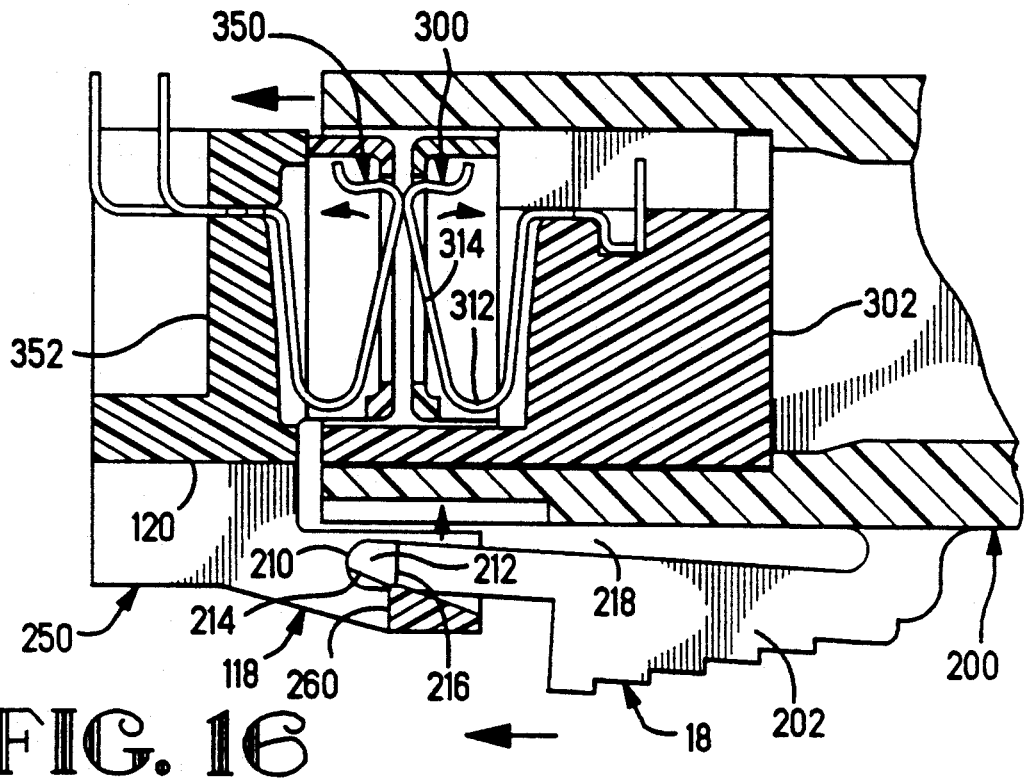
Figure 17:
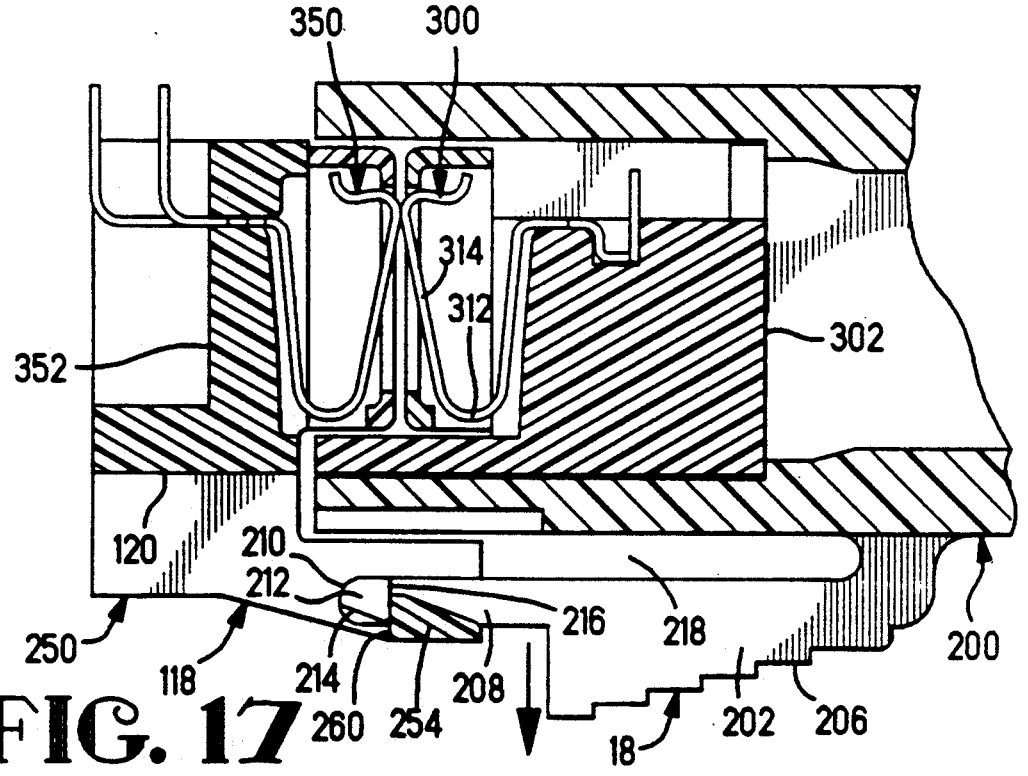
Figure 18:
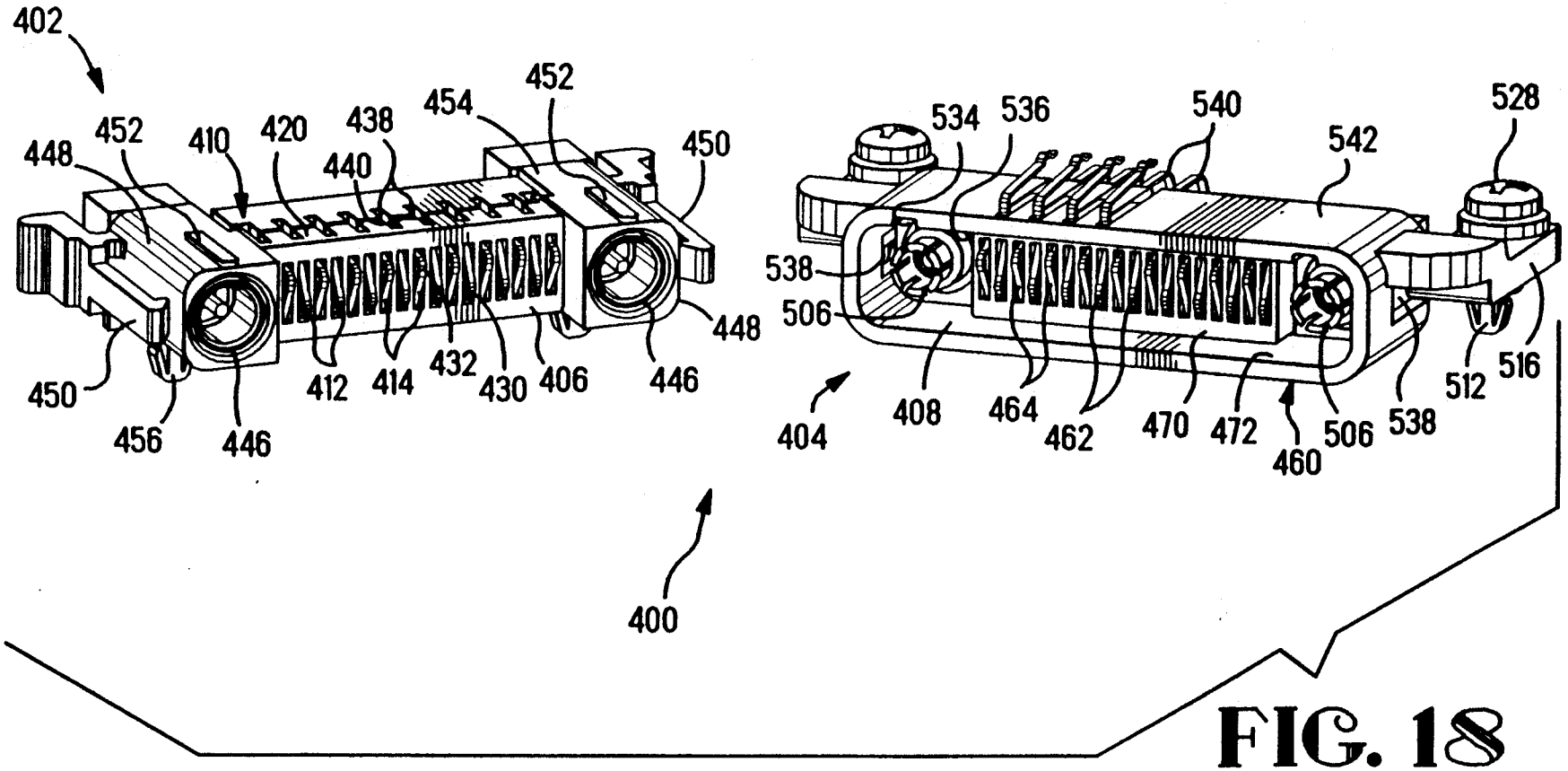
FIGS. 18 and 19 are front and rear isometric views of mating connectors of another embodiment of contact members of the present invention, and an alternative latching arrangement.
Figure 19:
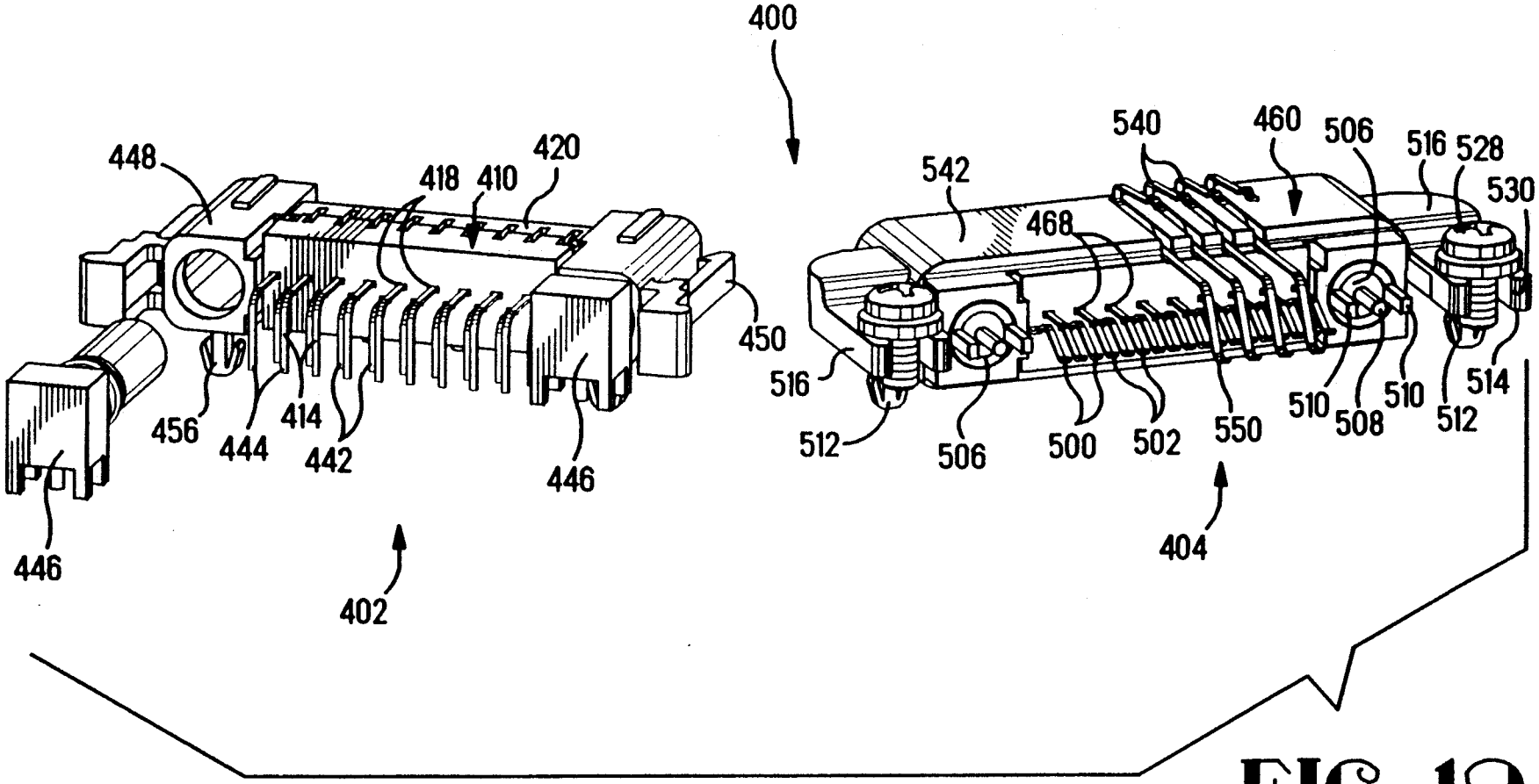

Also in FIGS. 14 to 17 is shown an alternate style of mating contacts 300,350 secured respectively in housing bodies 302,352 of connectors 200,250. Contact 300 includes a body section 304, rear contact section 306, transverse central section 308 extending from body section 304 at first bend section 310 to a second bend section 312, and angled elongate front section 314 extending from second bend section 312 to a free end 316. Central section 308 extends along and slightly spaced from an overstress surface 318 defined by the front surface of housing body 320. Mating contact 350 is configured identical to contact 300, except that rear contact section 352 is adapted for circuit board mounting while rear contact section 306 of contact 300 is an IDC section for wire termination. Contact surfaces 322,354 engage initially as shown in FIG. 15 and free ends of contacts 300,350 begin deflection and rotation about the second bends. In FIGS. 16 and 17 the angled elongate front sections are rotated into their mated condition, with contact surfaces 322,354 under nominal contact normal force. With this more robust contact design, the general configuration accommodates wide tolerance variations so as to evenly distribute the stresses over the spring length to make the most efficient use of the spring material. Such contacts may be made of phosphor bronze alloy, for example, having lower yield strength, and could be expected to provide longer in-service life.

Figure 20:
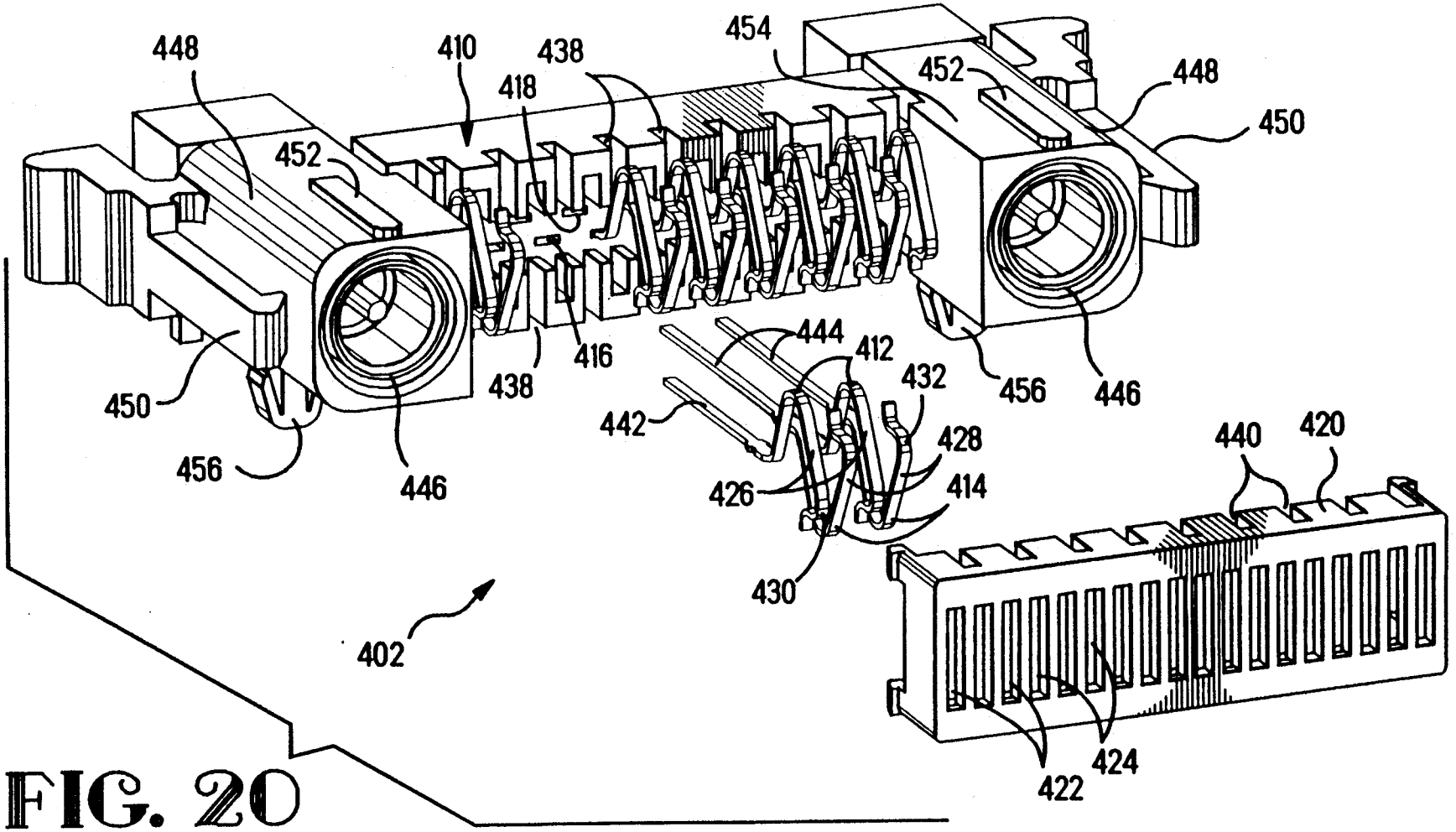
FIGS. 20 and 21 are exploded isometric views of the connectors of FIGS. 18 and 19 respectively.
Figure 21:
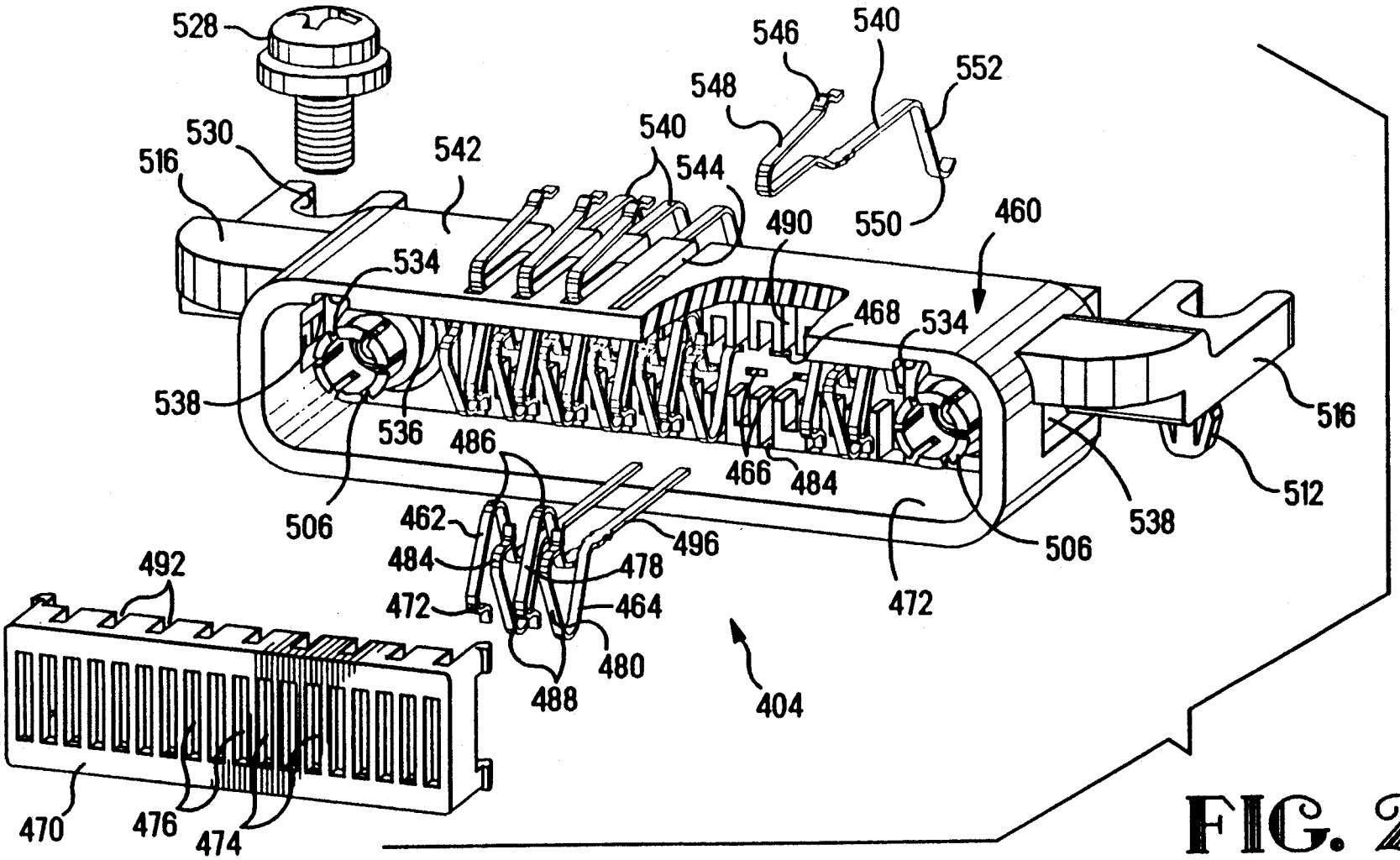
Figure 22:
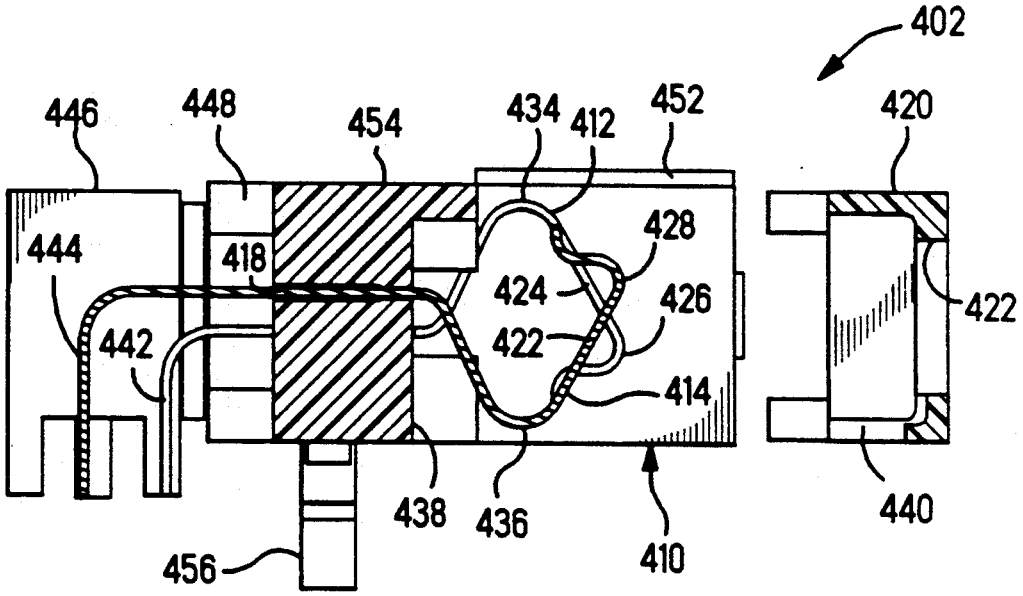
FIG. 22 is a longitudinal section view of the connector of FIG. 20.
Figure 23:
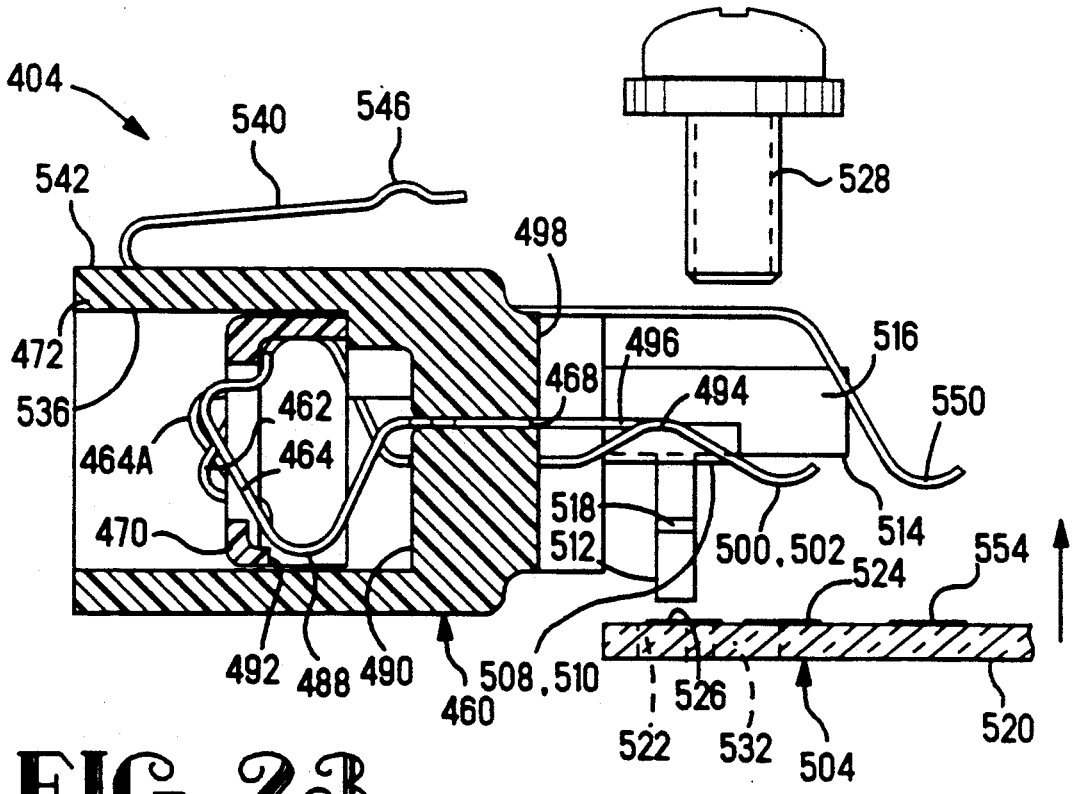
FIGS. 23 to 25 are longitudinal section views of the connector of FIG. 21 shown being mounted to a printed circuit board.
Figure 24:
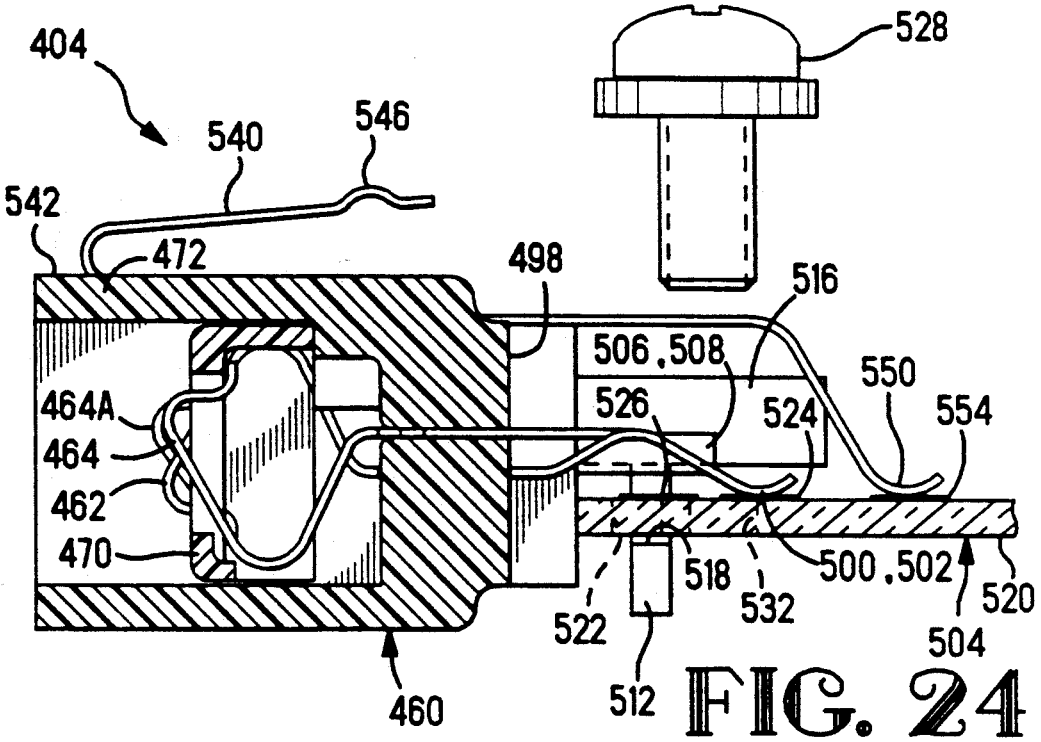
Figure 25:
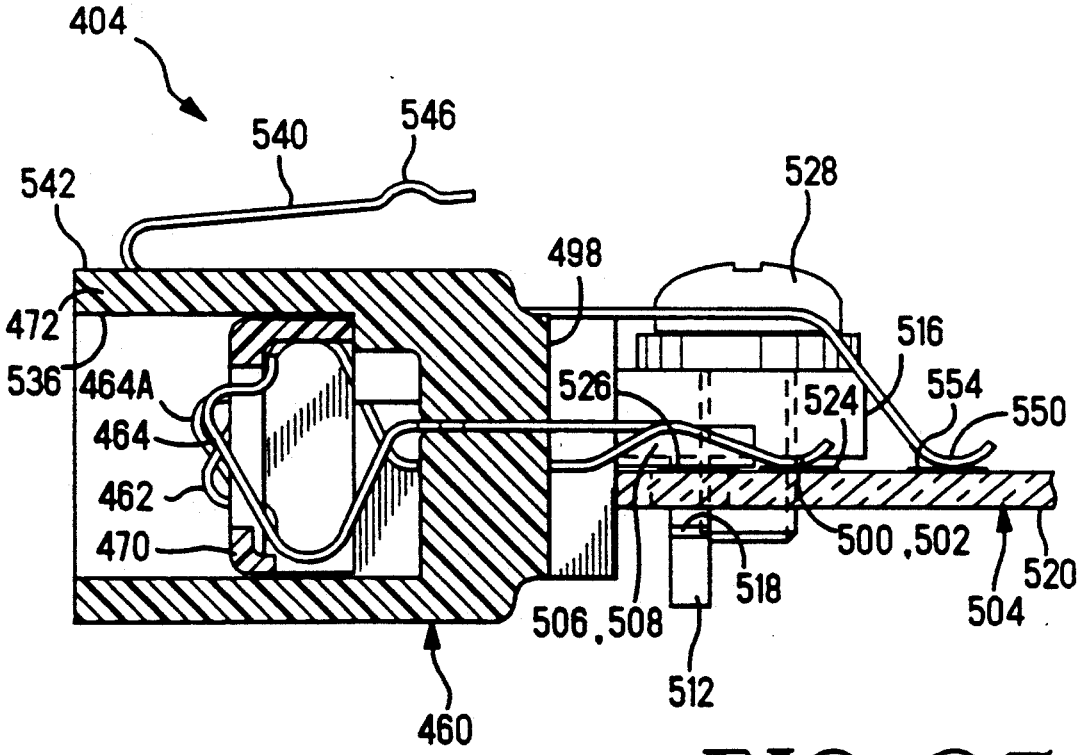

Another embodiment of the present invention is shown in FIGS. 18 to 25, comprising a connector assembly 400 having a first connector 402 matable with a second connector 404 at respective opposing mating faces 406,408. First connector 402 is seen in FIGS. 20 and 22 to include a housing body 410 and contact members 412,414 secured in housing body 410 by being force fit into respective small passageways 416,418 and having a front cover 420 latchable to a front end thereof similarly to front cover 134 of FIG. 9, to define discrete recesses 422,424 for front contact sections 426,428. Contact members 412,414 are similar to contact members 350 of FIGS. 14 and 15, with front contact sections 426,428 extending in opposing directions to contact surfaces 430,432 extending through recesses 426,428 and forwardly of front cover 420, and aligned in two rows. Bends 434,436 of contact members 412,414 permit deflection of front contact sections 422,424 upon mating, with relief recesses 438 provided in housing body 410 and 440 in front cover 420 to provide clearance for bends 434,436.

Initially straight rear contact sections 442,444 are bent around right angle bends after mounting in housing body 410 (FIG. 19), for right angle mounting to a circuit board (not shown) by conventional insertion into plated through-holes thereof and soldering. Board-mountable coaxial connectors 446 are secured in cavities of end portions 448 of housing body 410 similarly to coaxial connectors 126 of FIGS. 1 and 11. The front portion of housing body 410 including end portions 448 and front cover 406 define a plug section adapted to mate with connector 404 which defines a receptacle or shroud section. Latch members 450 are disposed along opposed end surfaces of housing body 410 for securing connector 402 to connector 404 when fully mated, and polarizing keys 452 are disposed along top surface 454 to provide for polarized mating of connectors 402,404. Board locks 456 are provided for mounting connector 402 to the printed circuit board, similarly to board locks 166 of FIG. 9.

Second connector 404 of FIGS. 21 and 23 to 25 includes housing body 460 and contact members 462,464 secured in housing body 460 by being force fit into respective small passageways 466,468 and having a front cover 470 latchable to a front end thereof within shroud section 472 similarly to front cover 34 of FIG. 6, to define discrete recesses 474,476 for front contact sections 478,480. Front contact sections 478,480 of contact members 462,464 are similar to front contact sections 426,428 of contact members 412,414 of connector 2, with front contact sections 478,480 similarly extending in opposing directions to contact surfaces 482,484 extending through recesses 474,476 and forwardly of front cover 470 and aligned in two rows. Bends 486,488 of contact members 462,464 permit deflection of front contact sections 478,480 upon mating, with relief recesses 490 provided in housing body 460 and relief recesses 492 provided in front cover 470 to provide clearance for bends 486,488.

Initially straight rear contact sections 494,496 are bent around gentle arcs rearwardly of rear face 498 of housing body 460 after contact members 462,464 are mounted in passageways 466,468, for convex contact sections 500,502 to be aligned in a common plane be surface mounted to a circuit board 504 (FIGS. 23 to 25) by conventional insertion into plated through-holes thereof. Board-mountable coaxial connectors 506 are secured in housing body 460 similarly to coaxial connectors 26 of FIGS. 1 and 13, but have a rearward contact section 508 of an inner or signal conductor thereof disposed between a pair of rearward ground contact sections 510 of the outer conductor coextending axially rearwardly from rear face 498 in a common plane to be surface mounted to circuit board 504, their common plane being offset upwardly from the plane of contact sections 500,502 of contact members 462,464. Board locks 512 extend from bottom surfaces 514 of mounting flanges 516 and include latch surfaces 518 which engage the bottom surface 520 of circuit board 504 after being inserted through first mounting holes 522, to temporarily hold connector 404 to board 504 in a first position in which contact sections 500,502 engage circuit pads 524 of board 504 and contact sections 508,510 of coaxial connector 506 are spaced upwardly of corresponding circuit pads 526 of board 504. Mounting fasteners 528 such as screws with lock washers are then extended through recesses 530 of mounting flanges 516 and threaded into second mounting holes 532 of board 504 having threaded inserts therein which relatively urges board 504 upwardly until circuit pads 526 engage contact sections 508,510 of coaxial connector 506; nuts may be used with fasteners 528. Thereafter the contact sections 508,510 are soldered, and contact sections 500,502 are spring biased against corresponding circuit pads 524 and preferably are also soldered.

Key-receiving channels 534 are defined along inside surface 536 of shroud section 472 for receipt of polarizing keys 452 of connector 402 during mating, assuring that the connectors are properly oriented with respect to each other prior to engagement of the contacts, as is conventional. Latch recesses 538 are disposed on outside surfaces of opposed ends of shroud section 472 and may be defined by apertures therethrough, and are cooperable with latch surfaces of latch arms 450 of connector 402 for securing connector 402 to connector 404 when fully mated.

Second connector 404 also is adapted to provide an electrical connection between circuit board 504 and a battery (not shown) mounted above connector 404. An array of battery-engaging contact members 540 is provided along top surface 542 of housing body 460. Each battery-engaging contact member 540 is forcefit into a respective channel 544 in top surface 542 and includes a first contact section 546 at the free end of a first spring arm section 548, and a second contact section 550 is defined at the free end of a second spring arm section 552 extending rearwardly of rear face 498 of housing body 460 and of contact sections 500,502. Second contact sections 550 are also aligned in a common plane opposed from corresponding circuit traces 554 of circuit board 504 and are similarly deflected under spring bias upon full connector mounting to circuit board 504 and are also subsequently soldered. Also related to such a battery, contact member 464A extends farther forwardly than all other contact members to electrically engage or mate first, and may be utilized to activate a switch disconnecting the battery from other electrical components on board 504 (not shown) since the mating connectors can now provide needed power to the components of circuit board 504.

The present invention provides a connector having an array of contacts across a mating face to be mated and unmated with those of a complementary connector manually for many cycles, having low mating force requirements and substantial durability. The contact design is useful in connectors which need not be hybrid connectors, and which may have two or more rows thereof where the width of the mating interface need not be narrow. The mating connectors may both be cable-to-cable if desired. Further since the rear contact sections may take any of several conventional designs, the contacts with the front contact design of the present invention requires only a small axial dimension in the mated connector assembly. The front contact sections may be shorter and be narrowed midway therealong allowing slight bending thereat decreasing stresses at the bend sections.

Variations and modifications may occur to the embodiments of the present inventions disclosed herein, which are within the spirit of the inventions and the scope of the claims.

We claim:

1. A matable electrical connector assembly of the type having an array of electrical contacts to be mated, comprising:

first and second connectors having first and second housings adapted to be mated to each other at respective first and second mating faces, said first and second connectors including pluralities of first and second contacts disposed in opposing arrays across said first and second mating faces, each said first and second contact having front and rear contact sections joined by body sections, said front contact sections being exposed at one of said first and second mating faces for mating, said body sections being retained within a body section of one of said first and second housings and rear contact sections being disposed at least proximate rearward sections of said first and second housings for electrical connections to other respective conductive means;

each said front contact section being disposed generally transverse of one of said first and second mating faces of a respective one of said first and second connectors, and each said front contact section at least including a contact surface portion extending forwardly of said housing body section of said respective connector to abuttingly engage an axially opposing contact surface portion of a said front contact section of an associated said contact of the other of said first and second connectors, each said front contact section extending to a respective said contact forwardly of a respective said body section thereof defining a fulcrum; and each of said first and second housings including a relief recess axially rearwardly of each said front contact section permitting deflection of said front contact section rearwardly thereinto upon abutting engagement with an opposing front contact section during mating of said first and second connectors.

2. An electrical connector assembly as set forth in claim 1 wherein said first and second housings include relief recesses into inside surfaces thereof adjacent respective ones of said bend sections of said first and second contacts providing clearance therefor upon said front contact sections being deflected during connector mating.

3. An electrical connector assembly as set forth in claim 1 wherein ones of said first contacts extend transversely in a first direction and other alternating therewith extend transversely in a second and opposing direction, and ones and others of said second contacts are arranged in complementary fashion thereto for mating engagement therewith upon connector mating.

4. An electrical connector assembly as set forth in claim 1 wherein first and second connectors include complementary latching means latchable after said contact surface portions of said pairs of first and second contacts engage under sufficient contact normal force defining complete connector mating.

5. An electrical connector assembly as set forth in claim 1 wherein said rear contact sections of ones of said first and second contacts include insulation displacement sections terminated to respective conductor wires proximate a cable receiving face of a respective one of said first and second connectors thereby defining a cable terminated connector.

6. An electrical connector assembly as set forth in claim 1 wherein said rear contact sections of ones of said first and second contacts include post sections extending from a mounting face of a respective one of said first and second connectors for electrical engagement with circuit means of a printed circuit board thereby defining a board mountable connector.

7. An electrical connector assembly as set forth in claim 1 wherein said rear contact sections of ones of said first and second contacts include spring arms extending to free ends engageable with and solderable to traces of a circuit board on a surface thereof for electrical connection with circuit means of said circuit board defining a surface mountable connector.

8. An electrical connector assembly as set forth in claim 1 wherein said first and second connectors include first and second coaxial connectors matable along said first and second mating faces, thereby defining hybrid connectors.

9. An electrical connector assembly as set forth in claim 1 wherein said contact surface portion of at least one of a mating pair of said first and second contacts is disposed on a convex arcuate embossment extending forwardly of a respective said mating face for engaging a said contact surface portion of the other of said mating pair.

10. An electrical connector assembly as set forth in claim 9 wherein said contact surface portion of the other of said mating pair of first and second contacts is disposed on a convex arcuate embossment extending forwardly of a respective said mating face opposing said convex arcuate embossment of said one thereof.

11. An electrical connector assembly as set forth in claim 9 wherein said contact surface portion of the other of said mating pair of first and second contacts is disposed on a straight spring arm extending transversely across a respective said mating face.

12. An electrical connector assembly as set forth in claim 1 wherein said contact surface portions of both of a mating pair of said first and second contacts comprise forwardmost extents of forwardly angled straight elongate spring arms positioned to oppose each other for mating.

13. An electrical connector assembly as set forth in claim 12 wherein said bend section is joined to a transverse contact section extending to a second bend at a forward end of said body section.

14. An electrical connector assembly as set forth in claim 12 wherein ones of said first contacts extend transversely in a first direction and others alternating therewith extend transversely in a second and opposing direction, and ones and others of said second contacts are arranged in complementary fashion thereto for mating engagement therewith upon connector mating.

15. An electrical connector assembly as set forth in claim 1 where each said contact free end comprises a rearwardly extending portion concluding in a transverse portion disposed behind a ledge of a respective said first and second connector and engaged therewith under preload when said first and second connectors are unmated, said rearwardly extending portion having an axial length selected to position said contact surface portion of said contact a selected distance forwardly of a respective one of said first and second mating faces.

16. An electrical connector assembly as set forth in claim 15 wherein said first and second housings each include a front cover member securable thereto across a said mating face thereof and having a transverse body section including an array of recesses through which said front contact sections extend for engagement by mating ones of said front contact sections.

17. A system of mating contacts comprising:

first and second contacts having front and rear contact sections joined by body sections, said front contact sections being exposed for mating at first and second mating faces, said body sections extending generally along a mating axis rearwardly from said first and second mating faces, each said front contact section being disposed generally transverse of one of said first and second mating faces and at least including a contact surface portion extending forwardly to engage an opposing contact surface portion of a said front contact section of an associated one of said contacts of the other of said first and second connectors, each said front contact section extending to a respective free end from a bend section of a respective said contact forwardly of a respective said body section thereof defining a fulcrum, and each said front contact section adapted to be deflectable rearwardly upon engagement of said contact surface portions.

18. A mating contact system as set forth in claim 17 wherein ones of said first contacts extend transversely in a first direction and others alternating therewith extend transversely in a second and opposing direction, and ones and others of said second contacts are arranged in complementary fashion thereto for mating engagement therewith upon connector mating.

19. A mating contact system as set forth in claim 17 where each said contact free end comprises a rearwardly extending portion concluding in a transverse portion.

20. A mating contact system as set forth in claim 17 wherein said contact surface portion of at least one of said first and second contacts is disposed on a convex arcuate embossment extending forwardly of a respective said mating face for engaging a said contact surface portion of the other.

21. A mating contact system as set forth in claim 20 wherein said contact surface portion of the other of said first and second contacts is disposed on a convex arcuate embossment extending forwardly of a respective said mating face opposing said convex arcuate embossment of said one thereof.

22. A mating contact system as set forth in claim 20 wherein said contact surface portion of the other of said first and second contacts is disposed on a straight spring arm extending transversely across a respective said mating face.

23. A mating contact system as set forth in claim 17 wherein said contact surface portions of both of said first and second contacts comprise forwardmost extents of forwardly angled straight elongate spring arms positioned to oppose each other for mating.

24. A mating contact system as set forth in claim 23 wherein said bend section is joined to a transverse contact section extending to a second bend at a forward end of said body section.

25. A mating contact system as set forth in claim 24 wherein ones of said first contacts extend transversely in a first direction and others alternating therewith extend transversely in a second and opposing direction, and ones and others of said second contacts are arranged in complementary fashion thereto for mating engagement therewith upon connector mating.

* * * * *